US012378090B2

(12) United States Patent
VanHorn

(10) Patent No.: US 12,378,090 B2
(45) Date of Patent: Aug. 5, 2025

(54) DUAL POSITION WEB TRANSFER SYSTEM

(71) Applicant: Davis-Standard, LLC, Pawcatuck, CT (US)

(72) Inventor: Shane VanHorn, East Syracuse, NY (US)

(73) Assignee: Davis-Standard, LLC, Pawcatuck, CT (US)

( * ) Notice: Subject to any disclaimer, the term of this patent is extended or adjusted under 35 U.S.C. 154(b) by 0 days.

(21) Appl. No.: 18/872,490

(22) PCT Filed: Jun. 12, 2023

(86) PCT No.: PCT/US2023/025072

§ 371 (c)(1),
(2) Date: Dec. 6, 2024

(87) PCT Pub. No.: WO2023/239969

PCT Pub. Date: Dec. 14, 2023

(65) Prior Publication Data

US 2025/0171262 A1 May 29, 2025

Related U.S. Application Data

(60) Provisional application No. 63/350,938, filed on Jun. 10, 2022.

(51) Int. Cl.

| | |
|---|---|
| ***B65H 19/28*** | (2006.01) |
| ***B65H 19/26*** | (2006.01) |
| ***B65H 19/30*** | (2006.01) |

(52) U.S. Cl.

CPC ..... *B65H 19/28* (2013.01); *B65H 19/26* (2013.01); *B65H 19/30* (2013.01); *B65H 2301/414* (2013.01); *B65H 2404/152* (2013.01)

(58) Field of Classification Search

CPC ..... B65H 19/26; B65H 19/28; B65H 19/30; B65H 2404/152

See application file for complete search history.

(56) References Cited

U.S. PATENT DOCUMENTS 5,417,382 A * 5/1995 Petitjean ..... B65H 19/28 242/527.3
5,620,151 A * 4/1997 Ueyama ..... B65H 19/30 242/533.8

(Continued)

FOREIGN PATENT DOCUMENTS

DE 102007026816 A1 12/2007

OTHER PUBLICATIONS

International Search Report issued in corresponding International Application No. PCT/US2023/025072, date mailed Oct. 11, 2023, pp. 1-2.

(Continued)

*Primary Examiner* — Sang K Kim
(74) *Attorney, Agent, or Firm* — Robinson & Cole LLP

(57) ABSTRACT

A web transfer system includes a first winder with a first core thereon and a second winder with a second core thereon. The web transfer system includes a roll changer carriage that is moveably mounted on a track and communicates with a carriage actuator. A linkage is pivotally mounted to the roll changer carriage and is movable between a first and second roll transfer positions. The linkage includes a lay-on roll and an auxiliary arm. The auxiliary arm is pivotable between a retracted and extended position. The auxiliary idler is rotatably mounted to the auxiliary arm. The lay-on roll and the auxiliary idler roll transfer a web from the first core to the second core.

19 Claims, 21 Drawing Sheets

(56) References Cited

U.S. PATENT DOCUMENTS

| | | | | |
|---|---|---|---|---|
| 6,220,541 | B1 * | 4/2001 | Caprario | B65H 19/2207 242/527.2 |
| 6,988,688 | B2 * | 1/2006 | Reinke | B65H 19/28 242/532.7 |
| 2004/0155138 | A1 * | 8/2004 | Kolbe | B65H 18/106 242/527.2 |
| 2013/0200200 | A1 | 8/2013 | Oravits et al. | |
| 2016/0257519 | A1 | 9/2016 | Hitsman et al. | |

OTHER PUBLICATIONS

International Preliminary Report on Patentability and Written Opinion of the International Searching Authority issued in corresponding International Application No. PCT/US2023/025072, date mailed Dec. 10, 2024, pp. 1-8.

* cited by examiner

DUAL POSITION WEB TRANSFER SYSTEM

CROSS-REFERENCE TO RELATED APPLICATIONS

The instant application is a non-provisional application of, and claims priority to, PCT Application No. PCT/US2023/025072, filed on Jun. 12, 2023, which is a PCT Application of and claims priority to U.S. Provisional Application No. 63/350,938, filed on Jun. 10, 2022, which is incorporated by reference in its entirety.

FIELD OF THE INVENTION

The present invention is directed to a web transfer system and more particularly to a web transfer system having stationary spindles and a centrally located web transfer assembly configured for transferring web from one core to another core during continuous web production and accomplishing the transfer with substantially no tail.

BACKGROUND

Turret winders wind webs of paper, paperboard and non-paper products, such as film and polyethylene, onto cores and into rolls which have uniform tension and density across the width of the web. A benefit of this type of winder is its ability to wind pressure sensitive materials under low winding pressures and to wind low tensile strength products under low tension. Each winder is custom engineered to meet the needs of the particular product to be produced and to be able to operate both continuously and intermittently. To be able to operate in a continuous mode, turret winders utilize various types of roll changers. Turret winders typically have a first core and at least a second core mounted for rotation on the turret winder. During operation, a web of sheet-type work material is wound around one of the first and second cores. When a desired amount of work material has been wound onto the core, the turret assembly is operable to index the other of the cores into a winding position.

Products, properties, speeds and widths vary from winder to winder and from plant to plant. The proper procedure of threading and attaching each particular product to the winder, therefore, varies as well from winder to winder.

In addition, many turret winders wind rolls of paper or film using a pressure roll, sometimes called rider roll, pack roll, lay-on roll, or bump roll. Typically, the lay-on roll is a straight beam (e.g., cylindrical shaft, spindle or tube) which applies pressure to the film as it is being wound onto one or more cores into one or more winding rolls positioned on a core shaft of the turret winder A drawback of turret winders is that they consume a large space envelope and involve indexing very heavy rolls of film from one position to another position and long tails of the web result during the transfer.

Thus, there is a need for an improved system for transferring a web from one core to another core that addresses the foregoing problems.

SUMMARY

There is disclosed herein a web transfer system. The web transfer system includes a first winder fixedly mounted to a foundation. The first winder has a first spindle rotatable about a first spindle axis and a first core removably mounted on the first spindle with a web rolled thereon. A second winder is fixedly mounted to the foundation and spaced apart from the first winder. The second winder includes a second spindle rotatable about a second spindle axis and a second core removably mounted on the second spindle. A roll changer carriage is moveably mounted on a track. A carriage actuator is in communication with the roll changer carriage. A linkage is pivotally mounted to the roll changer carriage about a linkage axis. The linkage is movable between a first roll transfer position and a second roll transfer position. The linkage includes a first lay-on roll rotatably mounted to the linkage about a first axis of rotation. A first auxiliary arm pivotally mounted about the first axis of rotation and being pivotable between a first retracted position and a first extended position. A first distal end of the first auxiliary arm has a first auxiliary idler roll rotatably mounted thereon. A second lay-on roll rotatably mounted to the linkage about a second axis of rotation, a second auxiliary arm pivotally mounted about the second axis of rotation and is pivotable between a second retracted position and a second extended position. A second distal end of the second auxiliary arm having a second auxiliary idler roll rotatably mounted thereon. Where the first lay-on roll and the first auxiliary idler roll are configured to transfer a web wound around the first core to the second core and the second lay-on roll and the second auxiliary idler roll are configured to transfer the web wound around the second core to the first core.

In some embodiments, the web transfer system includes a first web-cutter that has a first web-cutter arm pivotally mounted on a first web-cutter axis and a first cutting edge positioned on a distal end of the first web-cutter arm, the first web-cutter is pivotal between a retracted position and a cutting position in which the web is cut.

In some embodiments, the web transfer system includes a second web-cutter in which a second web-cutter arm is pivotally mounted on a second web-cutter axis and a second cutting edge positioned on a distal end of the second web-cutter arm, the second web-cutter is pivotal between a retracted position and a cutting position in which the web is cut.

In some embodiments, the first auxiliary idler roll which is pivotable to the first extended position during cutting and transfer of the web from the first core to the second core.

In some embodiments, a second auxiliary idler roll which is pivotable to the extended position during cutting and transfer of the web from the second core to the first core.

In some embodiments, a crown roll pivotally mounted about the linkage axis, the crown roll being in rolling engagement with the web.

There is disclosed herein, a method of transferring a web between two winder spindles. The method includes providing the web transfer system of any of the preceding claims; pivoting the linkage so that the second lay-on roll is in proximity to the first core; backing the roll changer carriage away from the first core and towards the second core; pivoting the linkage so that the first lay-on roll is in proximity to the second core; pivoting the first auxiliary arm so that the first auxiliary idler roll is in an engaged position; pivoting the second web-cutter arm so that the second web-cutter is in the cutting position; and cutting the web with the second cutting edge thereby severing the web from the first core and transferring the web to the second core.

In some embodiments, the web is transferred to the second core with substantially no tail.

In some embodiments, the second web-cutter arm pivots the second web-cutter to the retracted position.

In some embodiments, the linkage pivots the first lay-on roll to assist winding the web on the second core.

In some embodiments, the second core is filled with the web, the roll change carriage backs away from the second core toward the first core.

In some embodiments, the linkage pivots the second lay-on roll in close proximity to the first core.

In some embodiments, the second auxiliary arm pivots the first auxiliary idler roll into the engaged position.

In some embodiments, the first web-cutter arm pivots the first web-cutter to the cutting position.

In some embodiments, the web is cut with the first cutting edge thereby severing the web from the second core and transferring the web to the first core.

In some embodiments, the web is transferred to the first core with substantially no tail.

In some embodiments, the first web-cutter arm pivots the web-cutter to the retracted position.

In some embodiments, the linkage pivots the second lay-on roll to assist winding the web on the first core.

There is disclosed herein, a web transfer system. The system includes a first winder fixedly mounted to a foundation, the first winder having a first spindle rotatable about a first spindle axis; a second winder fixedly mounted to the foundation and being spaced apart from the first winder, the second winder having a second spindle rotatable about a second spindle axis; a roll changer carriage moveably mounted on a track; a carriage actuator configured to actuate the roll changer carriage; a linkage pivotally mounted to the roll changer carriage about a linkage axis, the linkage being movable between a first roll transfer position and a second roll transfer position; a first lay-on roll rotatably mounted to the linkage about a first axis of rotation; a first auxiliary arm pivotally mounted about the first axis of rotation so as to be pivotable between a first retracted position and a first extended position; and a first auxiliary idler roll rotatably mounted on a first distal end of the first auxiliary arm; the first lay-on roll and the first auxiliary idler roll are configured to transfer a web that is wound around a first core on the first spindle to a second core on the second spindle.

In some embodiments, the web transfer system further includes a second lay-on roll rotatably mounted to the linkage about a second axis of rotation; a second auxiliary arm pivotally mounted about the second axis of rotation so as to be pivotable between a second retracted position and a second extended position; and a second auxiliary idler roll rotatably mounted on a second distal end of the second auxiliary arm.

In some embodiments, the second lay-on roll and the second auxiliary idler roll are configured to transfer the web that is wound around the second core on the second spindle to another first core on the first spindle.

In some embodiments, the web transfer system further includes a first web-cutter having a first web-cutter arm pivotally mounted on a first web-cutter axis and a first cutting edge positioned on a distal end of the first web-cutter arm, the first web-cutter being pivotal between a retracted position and a cutting position in which the web is cut.

In some embodiments, the web transfer system further includes a second web-cutter having a second web-cutter arm pivotally mounted on a second web-cutter axis and a second cutting edge positioned on a distal end of the second web-cutter arm, the second web-cutter being pivotal between a retracted position and a cutting position in which the web is cut.

In some embodiments, the first auxiliary idler roll is configured to be in the first extended position during cutting and transfer of the web from the first core to the second core.

In some embodiments, the second auxiliary idler roll is configured to be in the second extended position during cutting and transfer of the web from the second core to the first core In some embodiments, the web transfer system further includes a crown roll pivotally mounted about the linkage axis, the crown roll configured to be in rolling engagement with the web.

There is disclosed herein a method of transferring a web between two winder spindles. The method includes providing the web transfer system; pivoting the linkage so that the second lay-on roll is in proximity to the first core; backing the roll changer carriage away from the first core and towards the second core; pivoting the linkage so that the first lay-on roll is in proximity to the second core; pivoting the first auxiliary arm so that the first auxiliary idler roll is in an engaged position; pivoting the second web-cutter arm so that the second web-cutter is in the cutting position; and cutting the web with the second cutting edge thereby severing the web from the first core and transferring the web to the second core.

In some embodiments, the web is transferred to the second core with substantially no tail.

In some embodiments, the second web-cutter arm pivots the second web-cutter to the retracted position.

In some embodiments, the linkage pivots the first lay-on roll to assist winding the web on the second core.

In some embodiments, when the second core is filled with the web, the roll change carriage backs away from the second core toward the first core.

In some embodiments, the linkage pivots the second lay-on roll in proximity to the first core.

In some embodiments, the second auxiliary arm pivots the first auxiliary idler roll into the engaged position.

In some embodiments, the first web-cutter arm pivots the first web-cutter to the cutting position.

In some embodiments, the method further includes cutting the web with the first cutting edge thereby severing the web from the second core and transferring the web to the first core.

In some embodiments, the web is transferred to the first core with substantially no tail.

In some embodiments, the first web-cutter arm pivots the web-cutter to the retracted position.

In some embodiments, the linkage pivots the second lay-on roll to assist winding the web on the first core.

BRIEF DESCRIPTION OF THE DRAWINGS

Referring now to the Figures, which are exemplary embodiments, and wherein the like elements are numbered alike.

DETAILED DESCRIPTION

Figure 7:
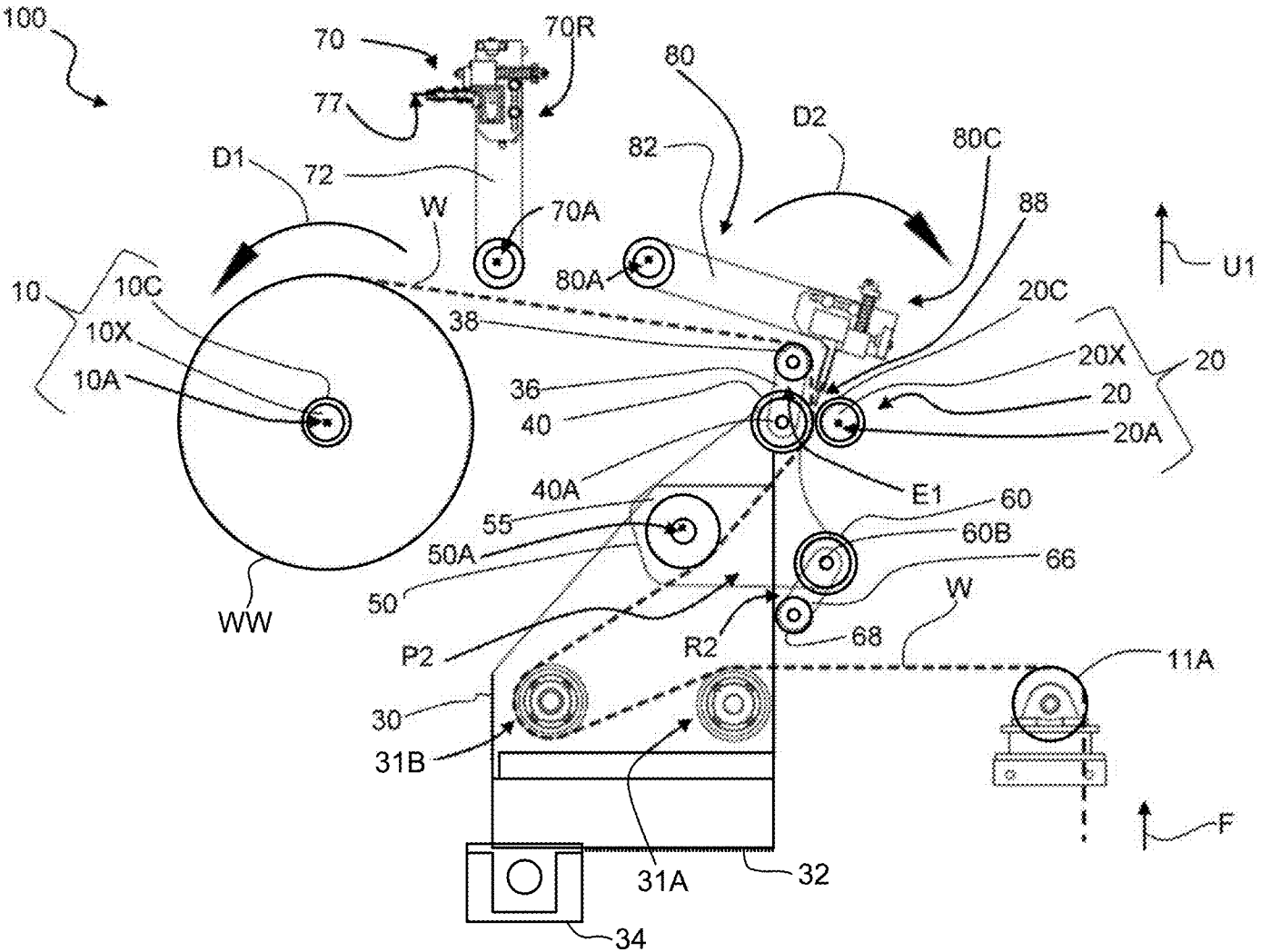
FIG. 7 is a schematic view of Step 6 of FIG. 5.
Figure 15:
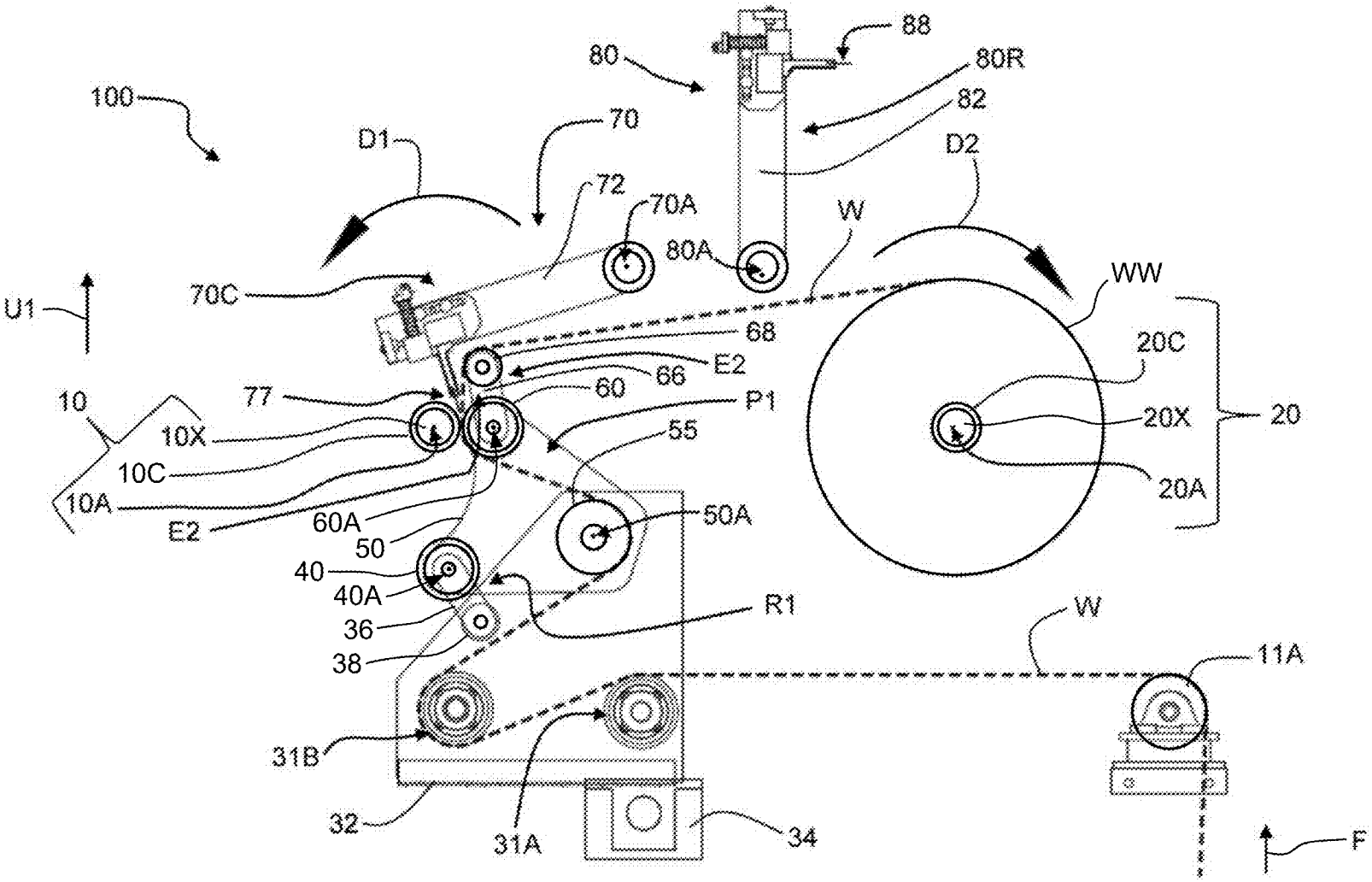
FIG. 15 is a schematic view of Step 11 of FIG. 9.

As best shown in FIGS. 7 and 15, a web transfer system is generally designated by the numeral 100. The web transfer system 100 includes a first winder 10 that is fixedly mounted to a foundation. The first winder 10 has a first spindle 10X that is rotatable about a first spindle axis 10A. A first core 10C (e.g., a tube) is removably mounted on the first spindle 10X with a web W (e.g., a continuous web of polymeric film, shown in the Figures in bold dashed lines for clarity) rolled thereon. The first spindle 10X is driven to rotate. When the first spindle 10X rotates, it causes the first core 10C to rotate which winds the web W around the first core 10C to form a roll of wound web WW. The web transfer system 100 includes a second winder 20 fixedly mounted to the foundation. The second winder 20 is spaced apart from the first winder 10. The second winder 20 has a second spindle 20X rotatable about a second spindle axis 20A and a second core 20C (e.g., a tube) removably mounted on the second spindle 20X. The second spindle 20X is driven to rotate. When the second spindle 20X rotates, it causes the second core 20C to rotate which winds the web W around the second core 20C to form a roll of wound web WW. The first spindle axis 10A is in fixed relation to the second spindle axis 20A and the foundation. Thus, the first spindle 10X is rotatably mounted on a frame that is in fixed relation to the foundation and the second spindle 20X is rotatably mounted on another frame that is in fixed relation to the foundation. The web is fed (i.e., in the direction of the arrow F) from a web processing and extrusion system (not shown) over rolls 11A, 31A and 31B. The web W is wound on the first core 10C in the direction indicated by the arrow D1 (e.g., counter clockwise); and the web W is wound on the second core 20C in the direction indicated by the arrow D2 (e.g., clockwise).

The web transfer system 100 includes a roll changer carriage 30 that is moveably mounted on a track 32 (e.g., a linear bearing track) and is centrally located substantially between the first winder 10 and the second winder 20. A carriage actuator 34 (e.g., a rack and pinion drive connected cross machine with a torque shaft and driven with a gear motor) in communication with the roll changer carriage 30. A linkage 50 (e.g., a generally triangular shaped linkage with three axis positions thereon) is pivotally mounted to the roll changer carriage 30 about a linkage axis 50A. The linkage 50 is movable (e.g., rotatable or pivotable) about a linkage axis of rotation 50A between a first roll transfer position P1 (see FIGS. 1-3 and 12-16) and a second roll transfer position P2 (see FIGS. 4, 6-8, 10 and 11).

As best shown in FIGS. 7, 15, and 18-21, the linkage 50 includes a first lay-on roll 40 rotatably mounted to the linkage 50 so as to be rotatable about a first lay-on roll 40 axis of rotation 40A. A first auxiliary arm 36 is pivotally mounted at a first proximal end 36P of the first auxiliary arm 36 so as to be rotatable about the first lay-on roll axis of rotation 40A and so as to be pivotable between a first retracted position R1 (see FIGS. 1-4, 8, and 10-16) and a first extended position E1 (see FIGS. 6, 7). A first distal end 36D of the first auxiliary arm 36 has a first auxiliary idler roll 38 rotatably mounted thereon. The first auxiliary idler roll 38 is rotatable about a first auxiliary arm axis 36D.

Figure 18:
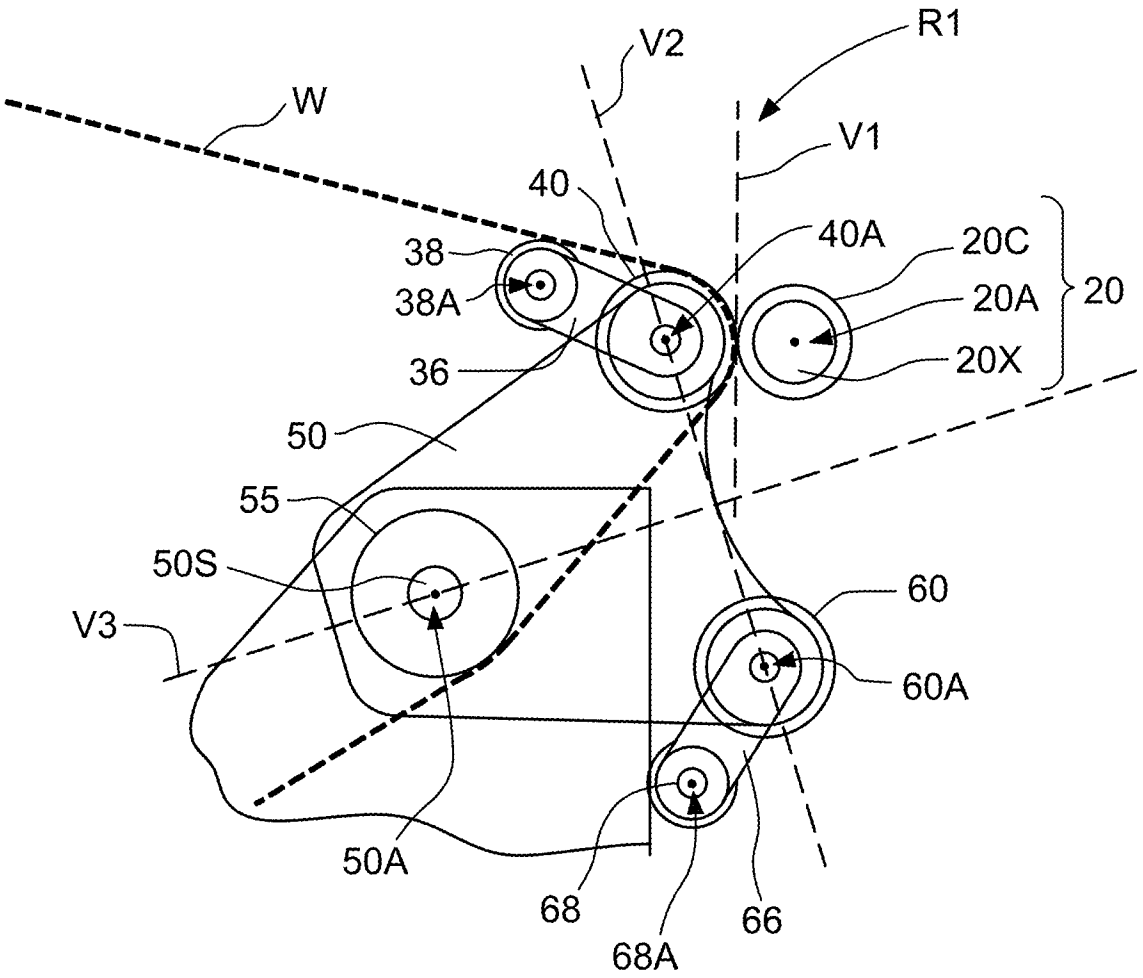
FIG. 18 is a schematic view of the linkage with the first lay-on roll in the first retracted position.
Figure 19:
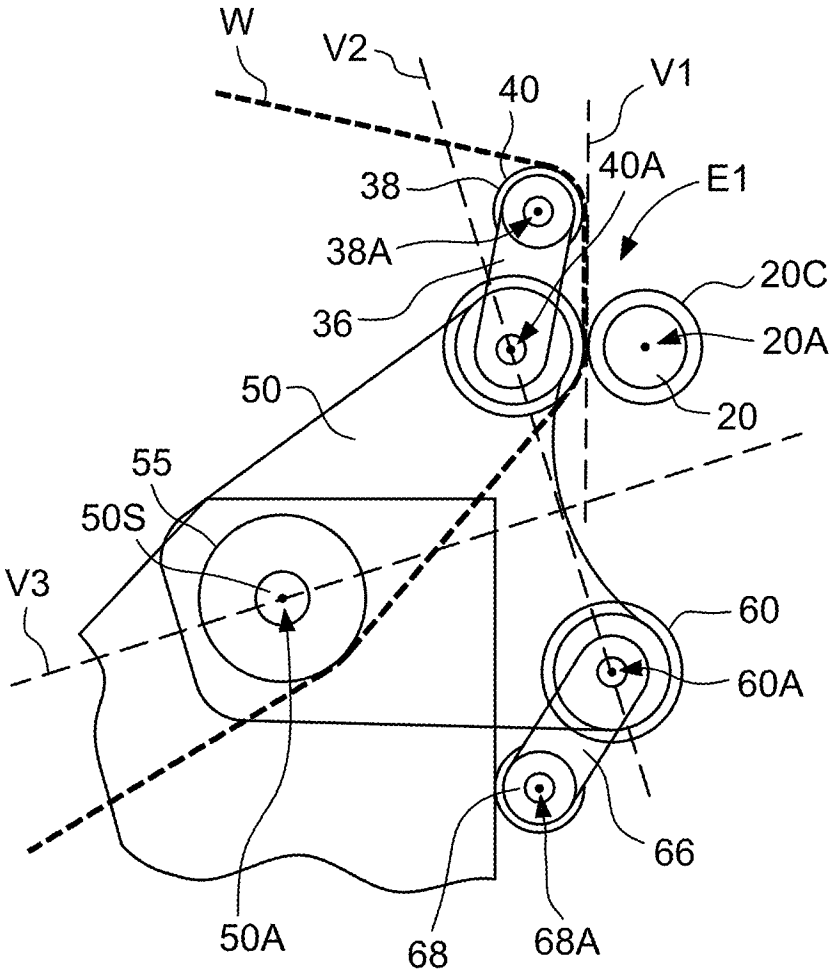
FIG. 19 is a schematic view of the linkage with the first lay-on roll in the first extended position.

As best shown in FIGS. 7, 15, and 18-21, the linkage 50 includes a second lay-on roll 60 rotatably mounted to the linkage 50 so as to be rotatable about a second lay-on roll axis of rotation 60A. The second lay-on roll 60 is disposed a fixed distance away from the first lay-on roll 40 on the linkage 50. A second auxiliary arm 66 is pivotally mounted at a second proximal end 66P of the second auxiliary arm 66 so as to be rotatable about the second lay-on roll axis 60A and so as to be pivotable between a second retracted position R2 (see FIGS. 1-4, 6-8, 10-13 and 16) and a second extended position E2 (see FIGS. 14 and 15). A second distal end 66D of the second auxiliary arm 66 has a second auxiliary idler roll 68 rotatably mounted thereon. Referring to FIGS. 18-19, the second auxiliary arm 66 is rotatable about a second auxiliary arm axis 36D. The second auxiliary arm 66 pivots about the second lay-on roll axis 60A to move the second auxiliary idler roll 68 from the second retracted position R2*s* to the second extended position E2. When in the second extended position E2, the second auxiliary idler roll 68 supports the web W such that an arc length of the web on the second lay-on roll 60 is reduced as compared with the retracted position, which suspends the web W and facilitates the cutting edge 88 to cut the web W. That is, the cutting edge 77 cuts the web W at a location where the Web W is suspended between the first core 10C and the second auxiliary idler roll 68.

The first lay-on roll 40 and the first auxiliary idler roll 38 are configured to transfer the web W wound around the first core 10C to the second core 20C. The first lay-on roll 40 applies pressure to the web W as it is wound around the core 20C. After the web W is transferred to the second core 20C, the second spindle 20X rotates to cause the second core 20C to rotate, which winds the web W around the second core 20C to build up the wound web WW. The first lay-on roll 40 is biased against the wound web WW and backs away from second core 20C as the wound web WW builds up so as to apply constant pressure to the wound web WW.

The second lay-on roll 60 and the second auxiliary idler roll 68 are configured to transfer the web W wound around the second core 20C to the first core 10C. The second lay-on roll 60 applies pressure to the web W as it is would around the first core 10C. After the web is transferred to the first core 10C, the first spindle 10X rotates to cause the first core 10C to rotate, which winds the web W around the first core 10C to build up the wound web WW. The second lay-on roll 60 is biased against the wound web WW and backs away from the first core 10C as the would web WW builds up so as to apply constant pressure to the wound web WW.

As best shown in FIGS. 7 and 15, the web transfer system 100 includes a first web-cutter 70 that has a first web-cutter arm 72 which is pivotally mounted on a first web-cutter axis 70A. The first web-cutter has a first cutting edge 77 that is positioned on a distal end of the first web-cutter arm 72. The first web-cutter 70 is pivotal between a retracted position 70R (see FIGS. 1-4, 6-8, 10-14 and 16) and a cutting position 70C (see FIG. 15) in which the web W is cut. In some embodiments, the first cutting edge 77 is held in a stationary position during the transfer of the web from one core to another and the web is pulled through the cutting edge 77 with the adhesive (e.g., tape or glue) on the core. In some embodiments, the cutting edge 77 is movable (e.g., a travelling "zip knife"). In some embodiments, the cutting edge 77 cuts the web W in the air around it (i.e., in a location where the web W is suspended) and in other embodiments the web is cut against the second core 20C.

As best shown in FIGS. 7 and 15, the web transfer system 100 includes a second web-cutter 80 that has a second web-cutter arm 82 which is pivotally mounted on a second web-cutter axis 80A. The second web-cutter 80 has a second cutting edge 88 positioned on a distal end of the second web-cutter arm 82. The second web-cutter 80 is pivotal between a retracted position 80R (see FIGS. 1-4, 6, 8, 10-16) and a cutting position 80C (see FIG. 7) in which the web W is cut. In some embodiments, the second cutting edge 88 is held in a stationary position during the transfer of the web from one core to another and the web is pulled through the cutting edge 88. In some embodiments the cutting edge 88 is movable (e.g., a travelling "zip knife"). In some embodiments, the cutting edge 88 cuts the web W in the air around it (i.e., in a location where the web W is suspended) and in other embodiments the web is cut against the first core 10C.

In some embodiments, as show in, e.g., FIG. 7, the first auxiliary idler roll 38 is pivotable to the first extended position E1 during cutting and transfer of the web W from the first core 10C to the second core 20C, with substantially no tail (i.e., little or no excess or wasted web). That is, the first auxiliary arm 36 pivots about the first lay-on roll axis of rotation 40A to move the first auxiliary idler roll 38 from the first retracted position R1 to the first extended position E1. When in the first extended position E1, the first auxiliary idler roll 38 supports the web W such that an arc length of the web on the first lay-on roll 40 is reduced as compared with the retracted position, which suspends the web W and facilitates the cutting edge 88 to cut the web W. That is, the cutting edge 88 cuts the web W at a location where the web W is suspended between the second core 20C and the first auxiliary roll 38. The web transfer system 100 has utility in that the web transfers can be done at a wide range of speeds from 10 FPM up to the machine mechanical limitation allow (bearings, shafts, etc.) making 3000 FPM even possible in some cases.

In some embodiments, the second auxiliary idler roll 68 is pivotable to the extended position E2 (e.g., FIG. 14) during cutting and transfer of the web W from the second core to the first core 10C, with substantially no tail (i.e., little or no excess or wasted web).

In some embodiments (e.g., FIG. 15), the web transfer system includes a crown roll 55 (e.g., a dead shafted roll or roll with a crowned exterior surface or stationary roll or undriven roll, see FIGS. 7 and 15) pivotally mounted about the linkage axis 50A, the crown roll 55 is in rolling engagement with the web W. In some embodiments, a shaft 50S is fixed to the frame 30, and the crown roll 55 is mounted onto shaft 50S and has bearings which allow the crown roll 55 to rotate on the linkage axis 50A when the web W is riding over it. The linkage 50 also rotates on the same linkage axis 50A. The crown roll 55 has utility in guiding the web W between the pressure rolls to allow web transfer between the first core 10C and the second core 20C. The crown roll 55 is located upstream of the lay-on rolls 40, 60 and is used for web spreading prior to the lay-on rolls 40, 60 and winding. This is to aid in removal of wrinkles in the web W that could potentially be wound into the first core 10C and the second core 20C. This crown roll 55 can be a straight cylindrical roll if web is not prone to wrinkles.

The present invention includes a method of utilizing the web transfer system 100 for transferring a web W between two winder spindles (e.g., the first core 10C positioned on the first spindle 10X and the second core 20C positioned on the second spindle 20X). The method is shown by virtue of the flow charts presented in FIGS. 5 and 9.

Figure 1:
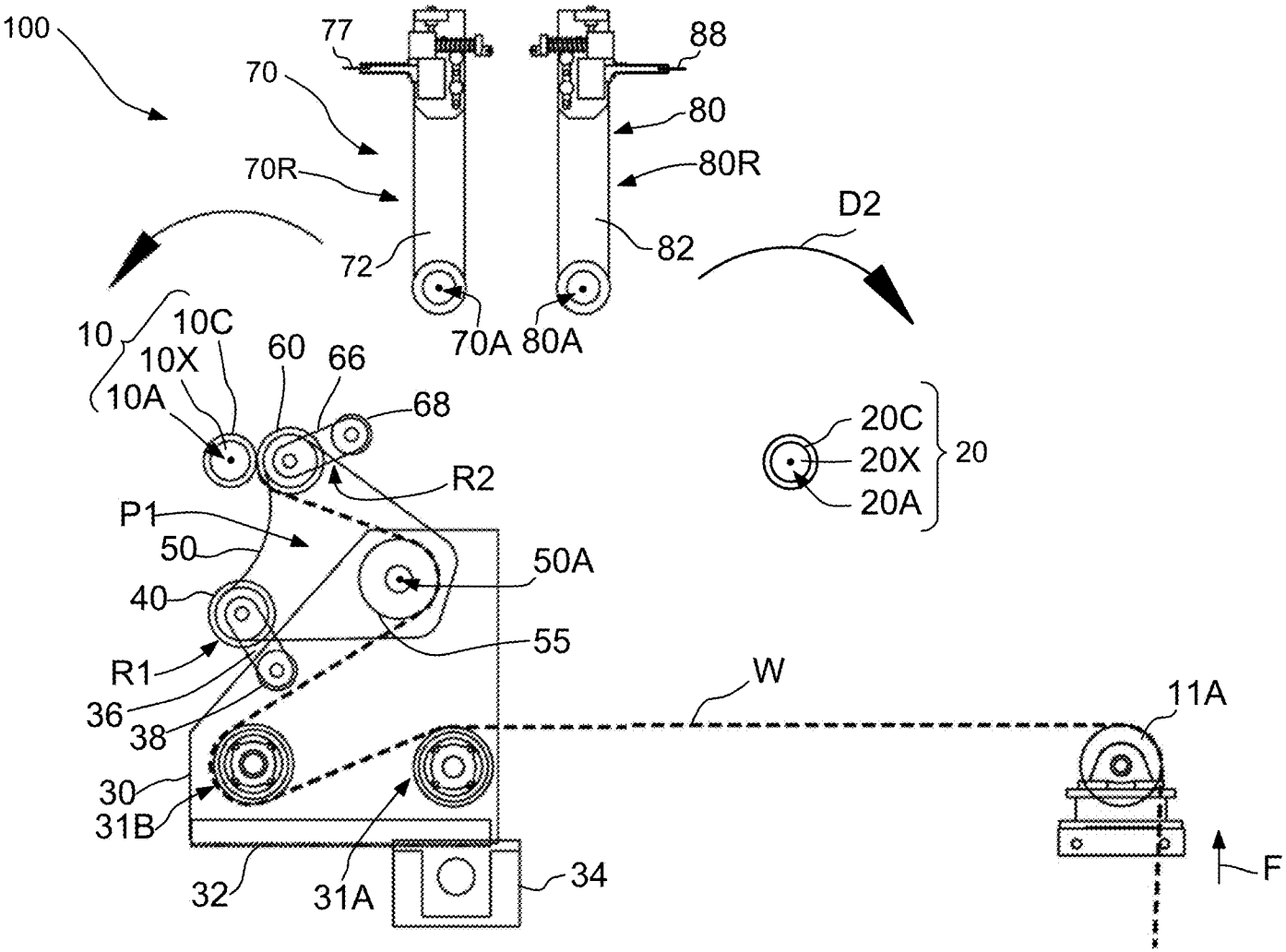
FIG. 1 is a schematic view of the dual position web transfer system of the present invention, shown performing Steps 1 and 2 of FIG. 5.
Figure 5:
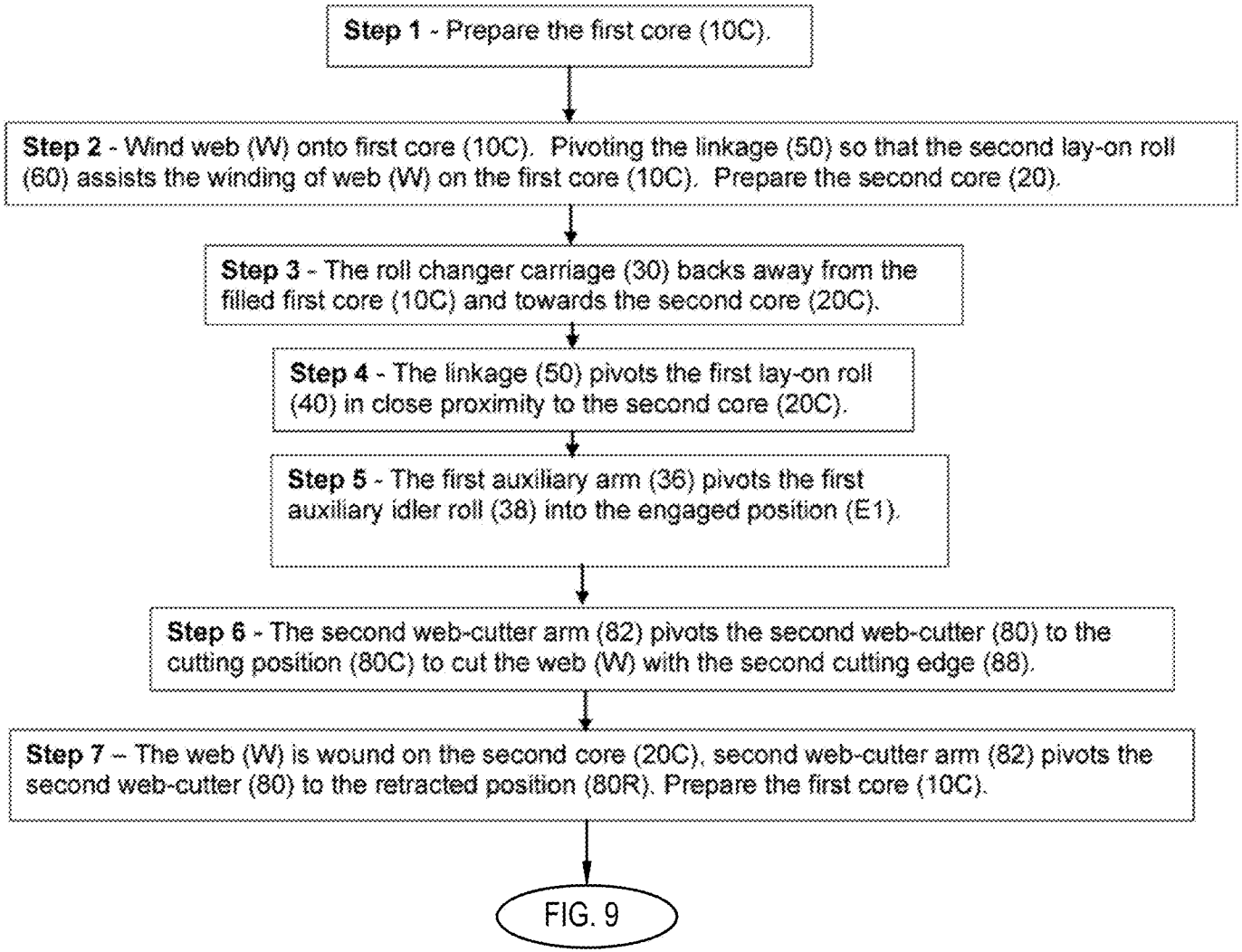
FIG. 5 is a flow chart of the method steps associated with transferring the web from a first core to a second core.

Step 1 in FIG. 5 includes preparing the first core 10C, which includes having the operator prepare the first core 10C with the incoming web W by attaching the web to first core 10C using adhesive applied to the first core 10C. It is noted that the step of manually attaching the web to the core is only done once during a start-up (thread up) of the machine where no web is attached to either core 10C or 20C but needs to be started on core 10C to begin the process. Subsequent transfers of the web from the first core 10C to the second core 20C and from the second core 20C to the first core is done automatically with the web transfer system 100 described herein. The first core 10C is manufactured from a plastic, fiber, steel, aluminum or composite material. The status of the positions of the components of the web transfer system 100 for Step 1 is shown in FIG. 1. For example, the linkage 50 is shown in the first roll transfer position P1.

Figure 2:
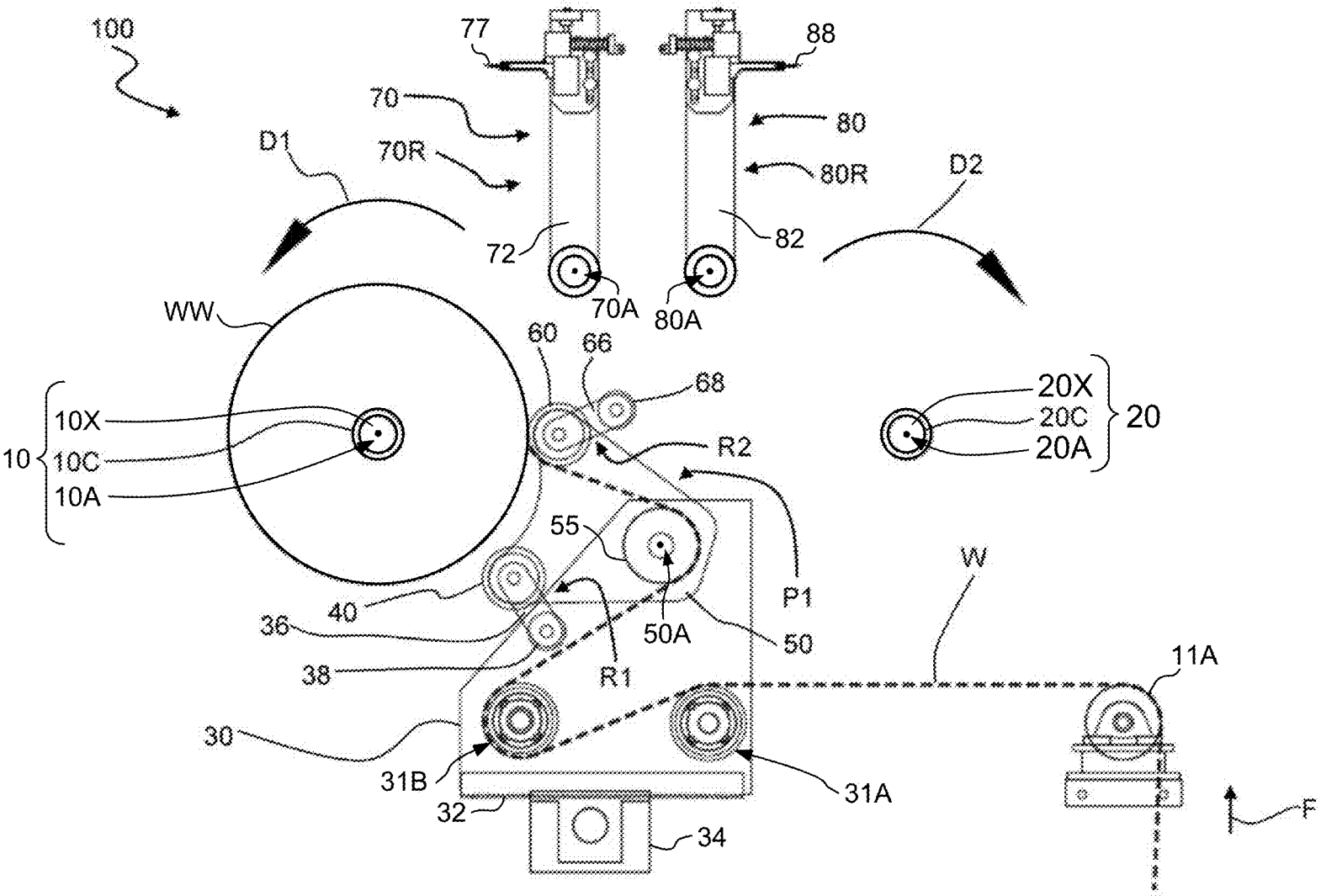
FIG. 2 is a schematic view of Step 2 of FIG. 5.

Step 2 in FIG. 5 is performed after attaching the web W to the first core 10C in Step 1 is completed. Thus, the upstream process for production of the web is started and the machine sped up to process speeds to wind the web W onto first core 10C. During Step 2 the linkage 50 is pivoted so that the second lay-on roll 60 can assist the winding of the web W on the first core 10C. The winding of the web on the first core 10X can be done in pressure roll (i.e., lay-on roll) 'contact mode' or in 'gap follow mode' utilizing a gear motor driver with positional feedback to move the roll changer carriage 30. The roll changer carriage 30 can also be actuated with the use of an air cylinder for full contact mode using air pressure. This can also be done as a dual positioning system with both a gearmotor and air cylinder, where the gear motor is disengaged with a clutch system allowing the air cylinder to take over without the drag effects of the gear reduction. During Step 2, the second core 20C is prepared by applying (e.g., automatically) the adhesive to the second core 20C, on the second spindle 20X for receiving the transferred web W from the first core 10C. The status of the positions of the components of the web transfer system 100 for Step 2 is shown in FIGS. 1 and 2, for example, the linkage 50 is shown in the first roll transfer position P1.

Figure 3:
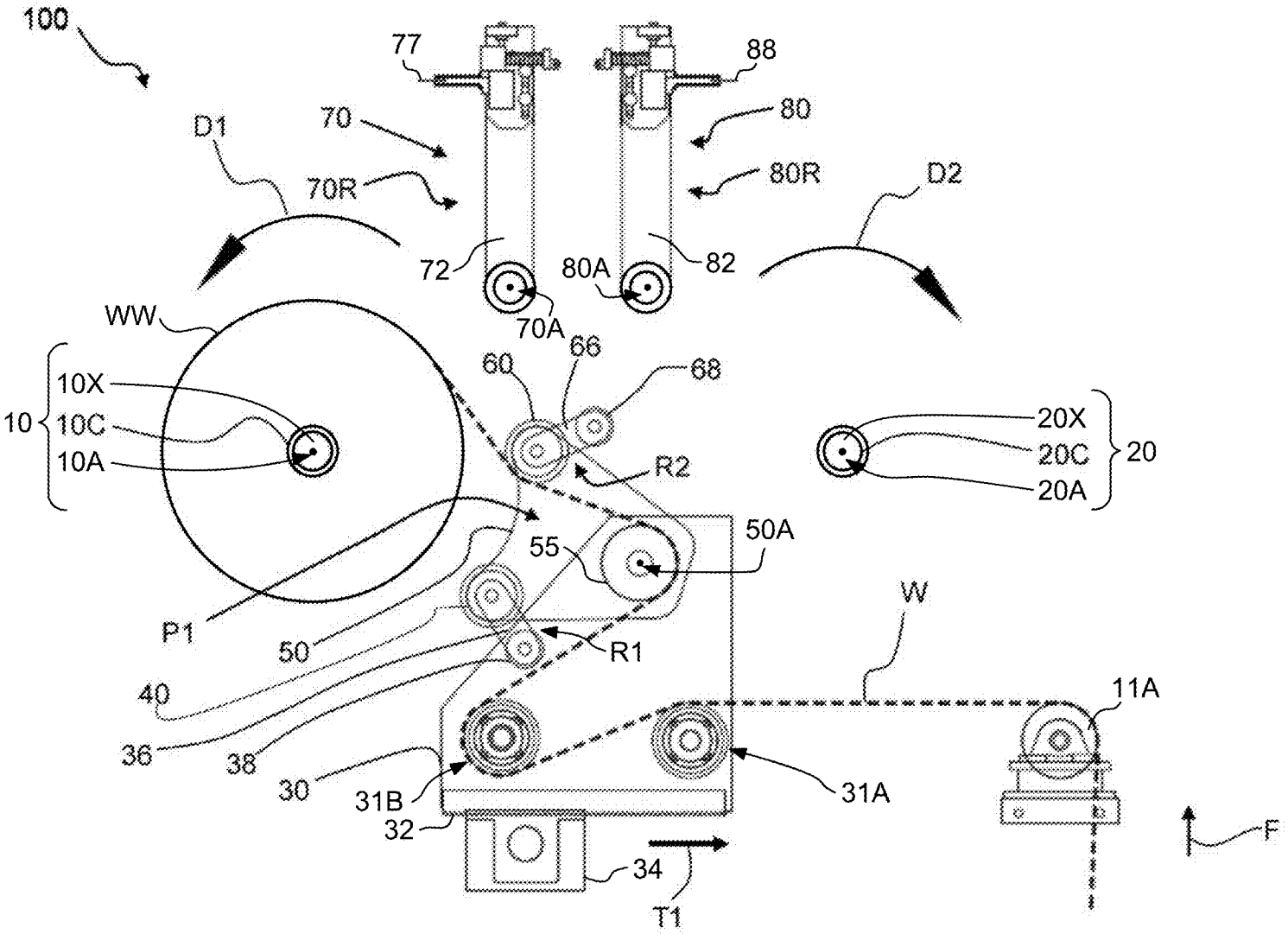
FIG. 3 is a schematic view of Step 3 of FIG. 5.

When the first core 10C nears its capacity (e.g., a predetermined roll diameter or weight) for receiving the web W, the transfer process is initiated manually or automatically, which includes Step 3 of FIG. 5 in which the roll changer carriage 30 backs away from the filled first core 10C and towards the second core 20C, indicated by the arrow T1 and the linkage 50 remains in the first roll transfer position P1, as shown in FIG. 3.

Figure 4:
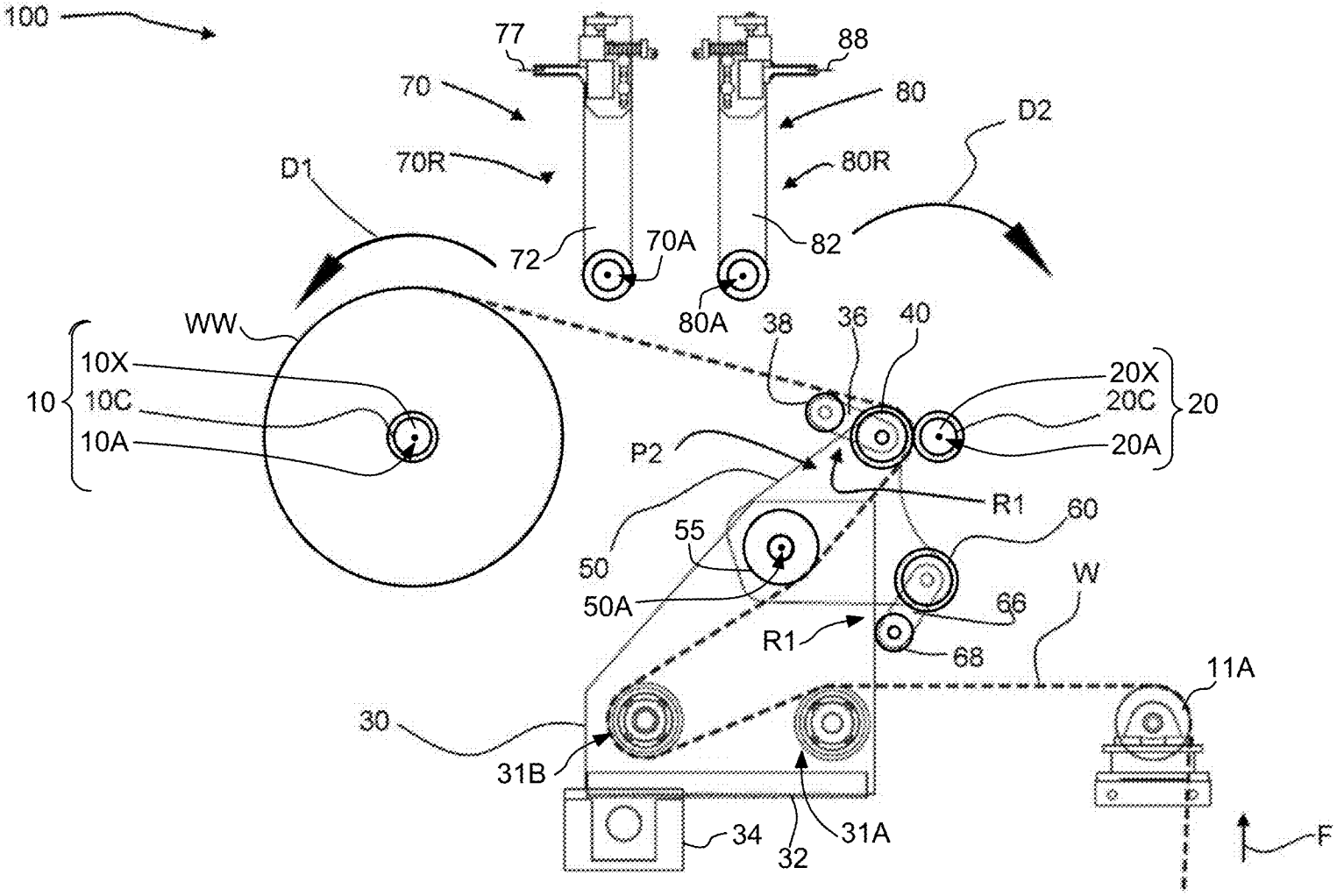
FIG. 4 is a schematic view of Step 4 of FIG. 5.

In Step 4 of FIG. 5 the linkage 50 pivots to the second roll transfer position P2 and the roll changer carriage 30 and the linkage 50 cooperate to position the first lay-on lay-on roll 40 in close proximity to the second core 20C, as shown in FIG. 4. Referring to FIGS. 18-19, when in the first retracted position R1, the first auxiliary arm 36 is pivoted away from (e.g., at an oblique angle with respect to) a first virtual plane V1 that bisects the first lay-on roll 40 and the second winder 20 when the first lay-on roll 40 is in close proximity to the second winder 20. When in the first retracted position R1, the first auxiliary idler roll 38 is on the same side of the first virtual plane V1 as the crown roll 55. There is a second virtual plane V2 that passes through the first lay-on roll axis 40A of the first lay-on roll 40 and the second lay-on roll axis 60A of the second lay-on roll 60A. When in the first retracted position R1, the first auxiliary idler roll 38 is on the same side of second virtual plane V2 as the crown roll 55. There is a third virtual plane V3 that passes through a linkage axis of rotation 50A of the linkage 50 and through a midpoint between the first lay-on roll axis 40A and the second lay-on roll axis 60A. When the first lay-on roll 40 is in close proximity to the second core 20C, the first auxiliary idler roll 38 is on the same side of the third virtual plane V3 as the second core 20C.

Figure 6:
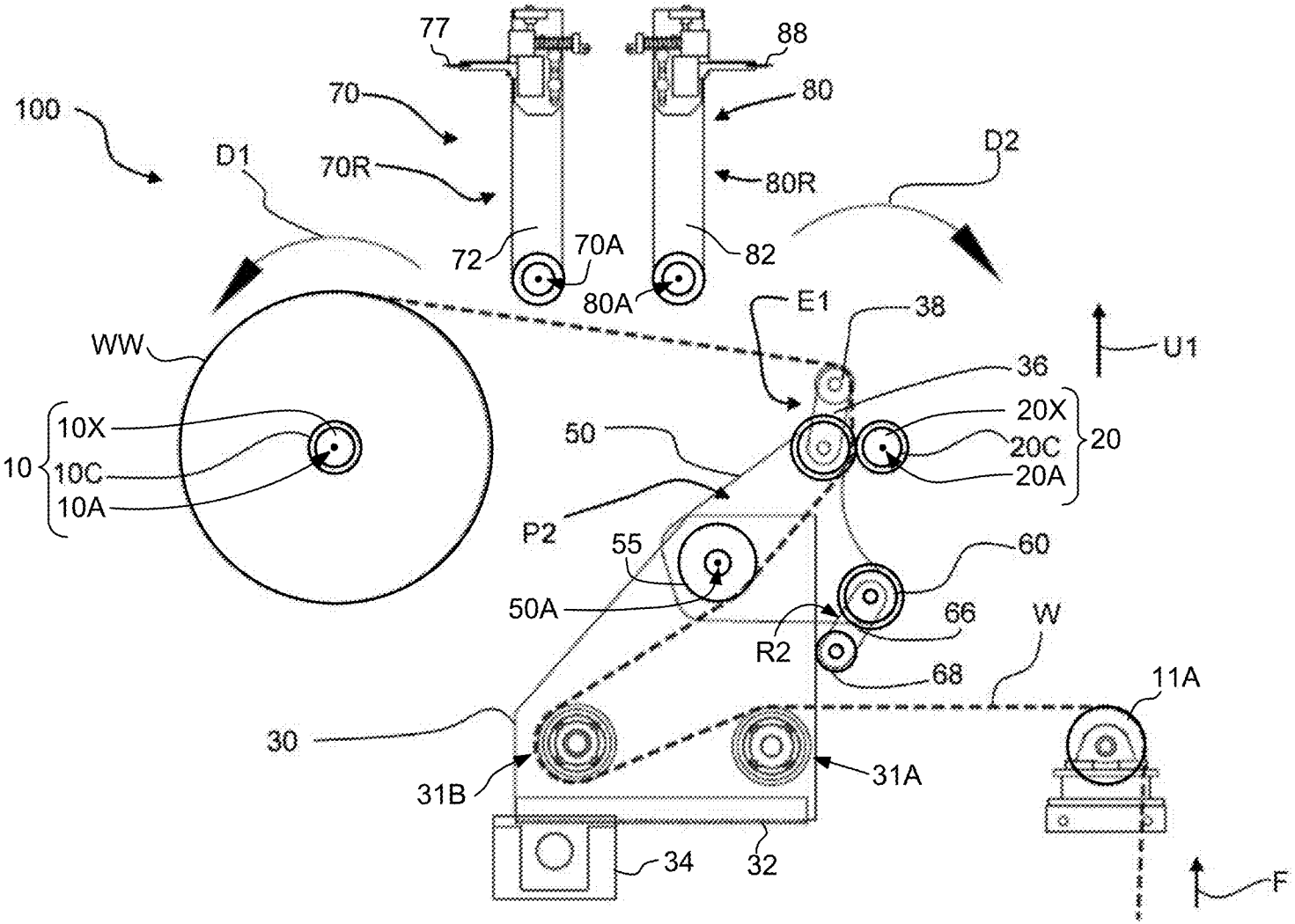
FIG. 6 is a schematic view of Step 5 of FIG. 5.

In Step 5 of FIG. 5 the first auxiliary arm 36 pivots the first auxiliary idler roll 38 into the first engaged position E1, thereby displacing the web W in the general direction of the arrow U1, as shown in FIG. 6. Referring to FIGS. 18-19, when in the first engaged position E1, the first auxiliary arm 36 is oriented approximately parallel with the first virtual plane V1. When in the first engaged position E1, the first auxiliary idler roll 38 is on the same side of the first virtual plane V1 as the crown roll 55. When in the first engaged position E1, the first auxiliary idler roll 38 is on a different side of the second virtual plane V2 from the crown roll 55. In some embodiments, when the first auxiliary idler roll 38 is in the first engaged position E1, the second auxiliary idler roll 68 is retracted and does not contact the web W.

In Step 6 of FIG. 5 the second web-cutter arm 82 pivots the second web-cutter 80 to the cutting position 80C to cut the web W with the second cutting edge 88, as shown in FIG. 7. With the lay-on roll 40 in close proximity (gap/space between so adhesive is not in contact with web W yet) to core 20C (the roll changer carriage 30 moves towards core 20C with carriage actuator 34 allowing the lay-on roll 40 to come in contact with second core 20C and the adhesive that had been applied to the second core 20C adheres to the web W with the lay-on pressure that is applied to the second core 20C and thus pulls the web W to be wound around second core 20C and as a result pulls the web W through the first cutting edge 77 and severs the web from first core 10C and begins winding onto the second core 20C. The cutting described in the present invention it is not limited in regard, as a flying knife can be used and the adhesive used on the core pulls the web in after the knife is actuated through the web, aiding attaching the severed web onto a new core.

Figure 8:
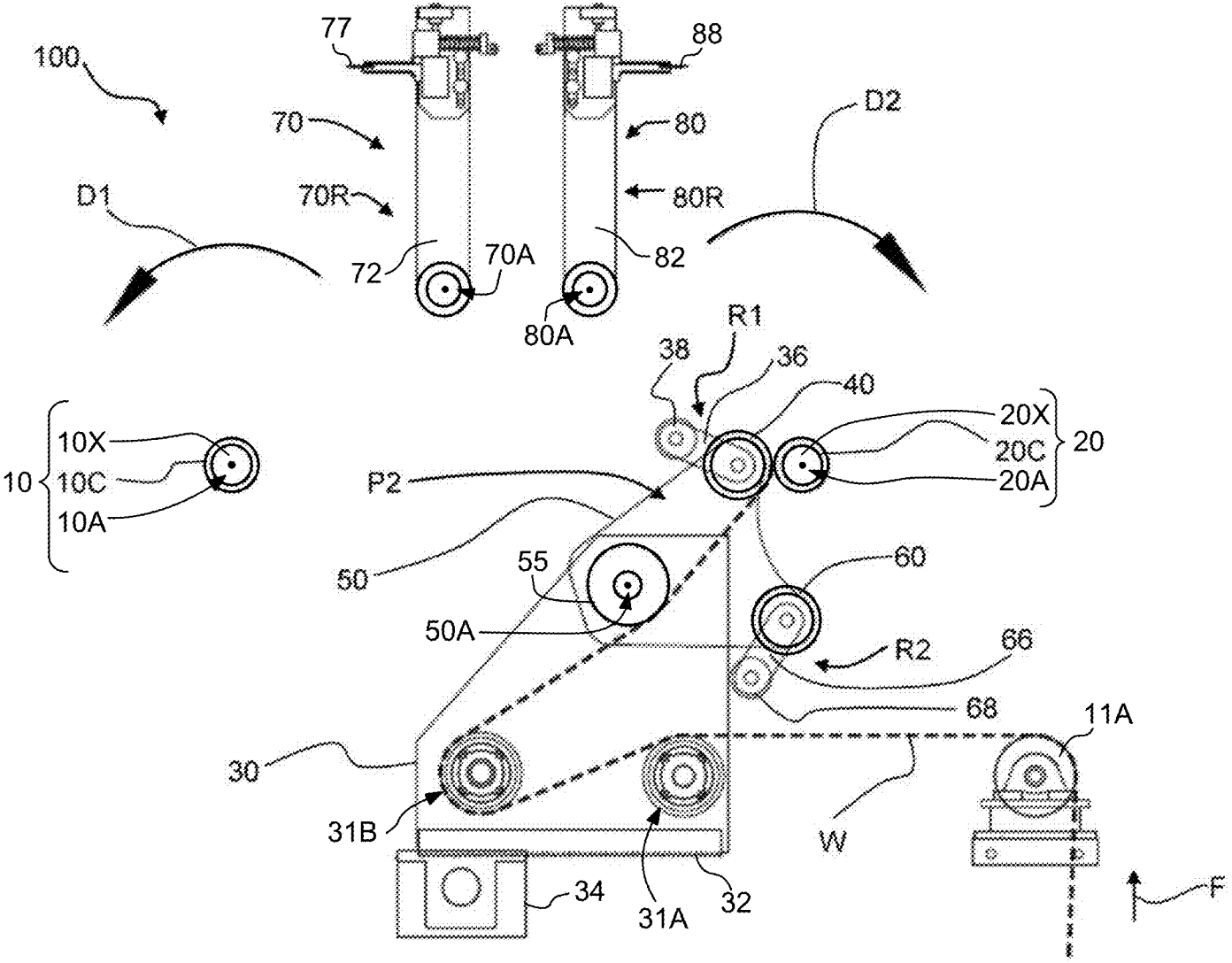
FIG. 8 is a schematic view of Step 7 of FIG. 5.

In Step 7 of FIG. 5, web W is wound on the second core 20C, second web-cutter arm 82 pivots the second web-cutter 80 to the retracted position 80R, as shown in FIG. 8. During Step 7, the first core 10C is prepared for receiving the web W transferred from the second core 20C, in a manner similar to that previously described herein.

Figure 9:
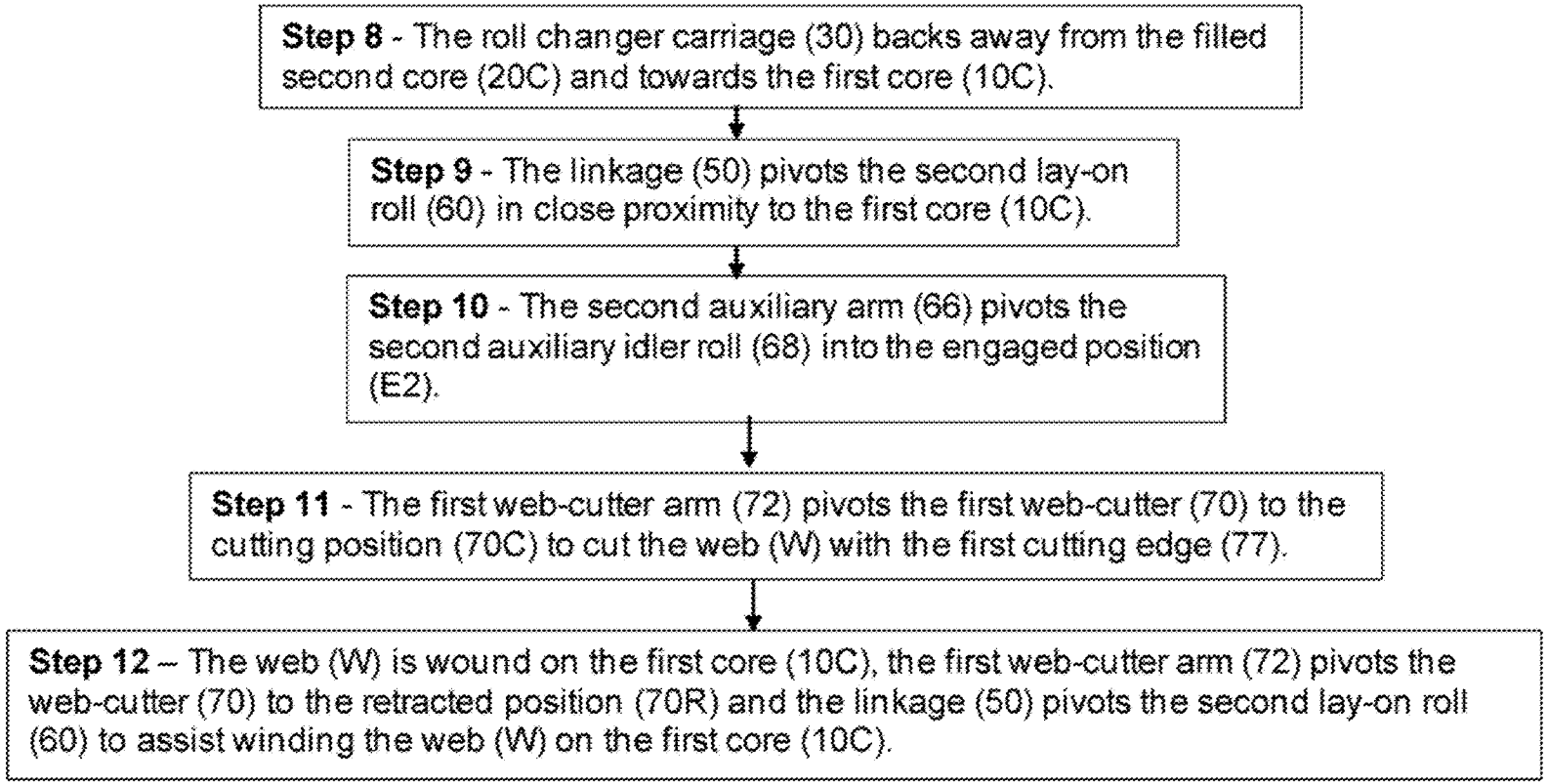
FIG. 9 is a flow chart of the method steps associated with transferring the web from the second core the first core.
Figure 10:
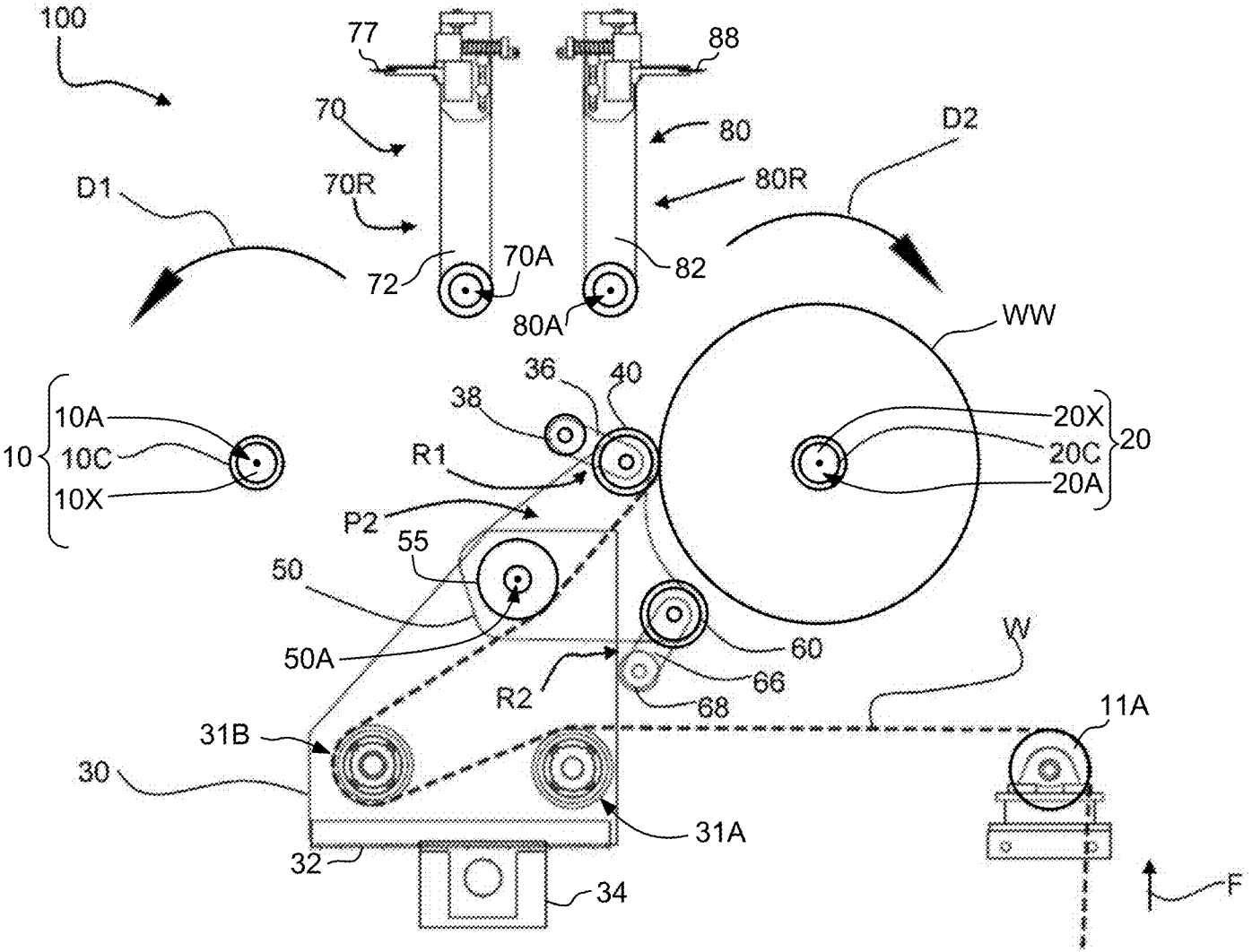
FIG. 10 is a schematic view of Step 7 of FIG. 5.
Figure 11:
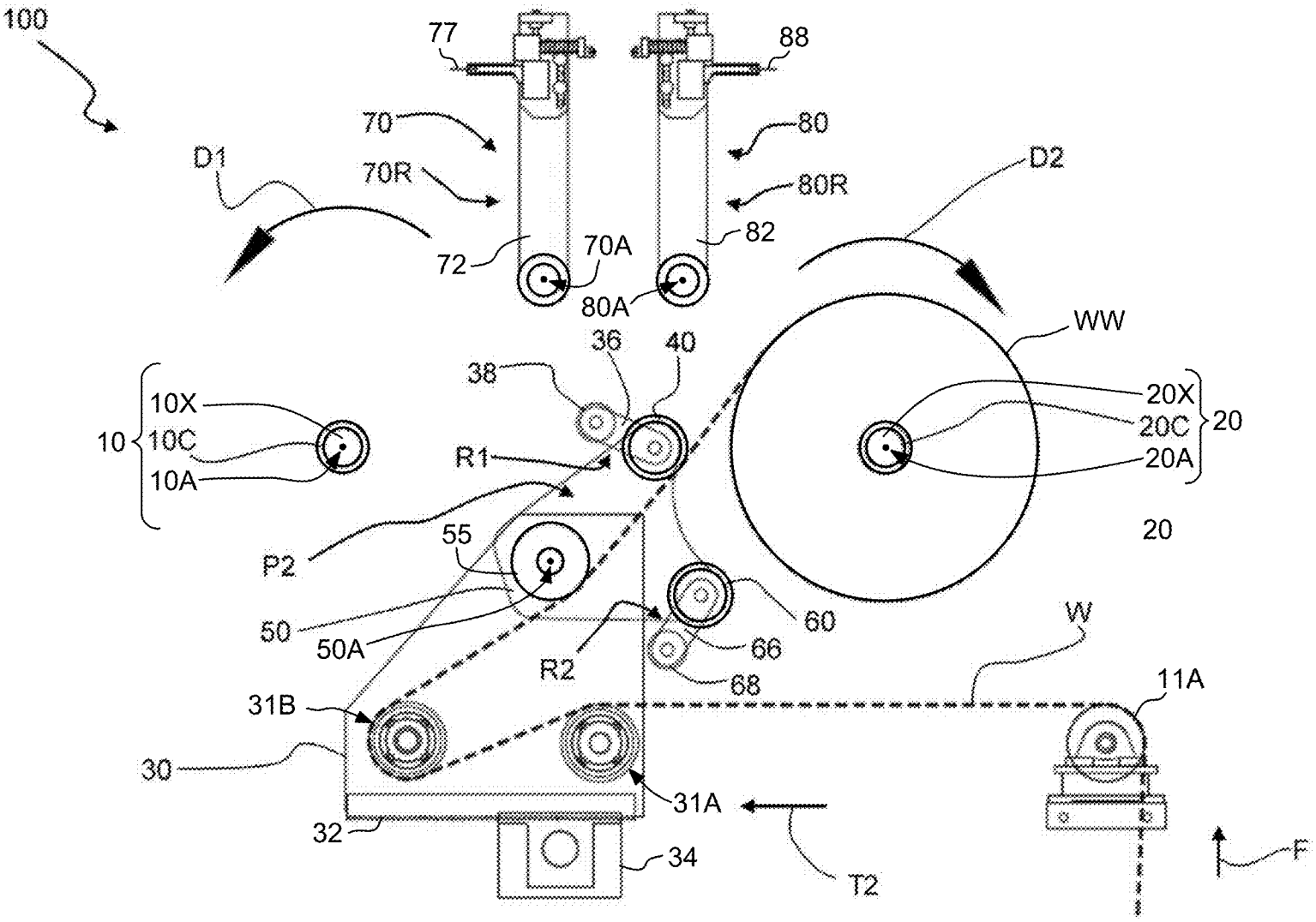
FIG. 11 is a schematic view of Step 8 of FIG. 9.
Figure 12:
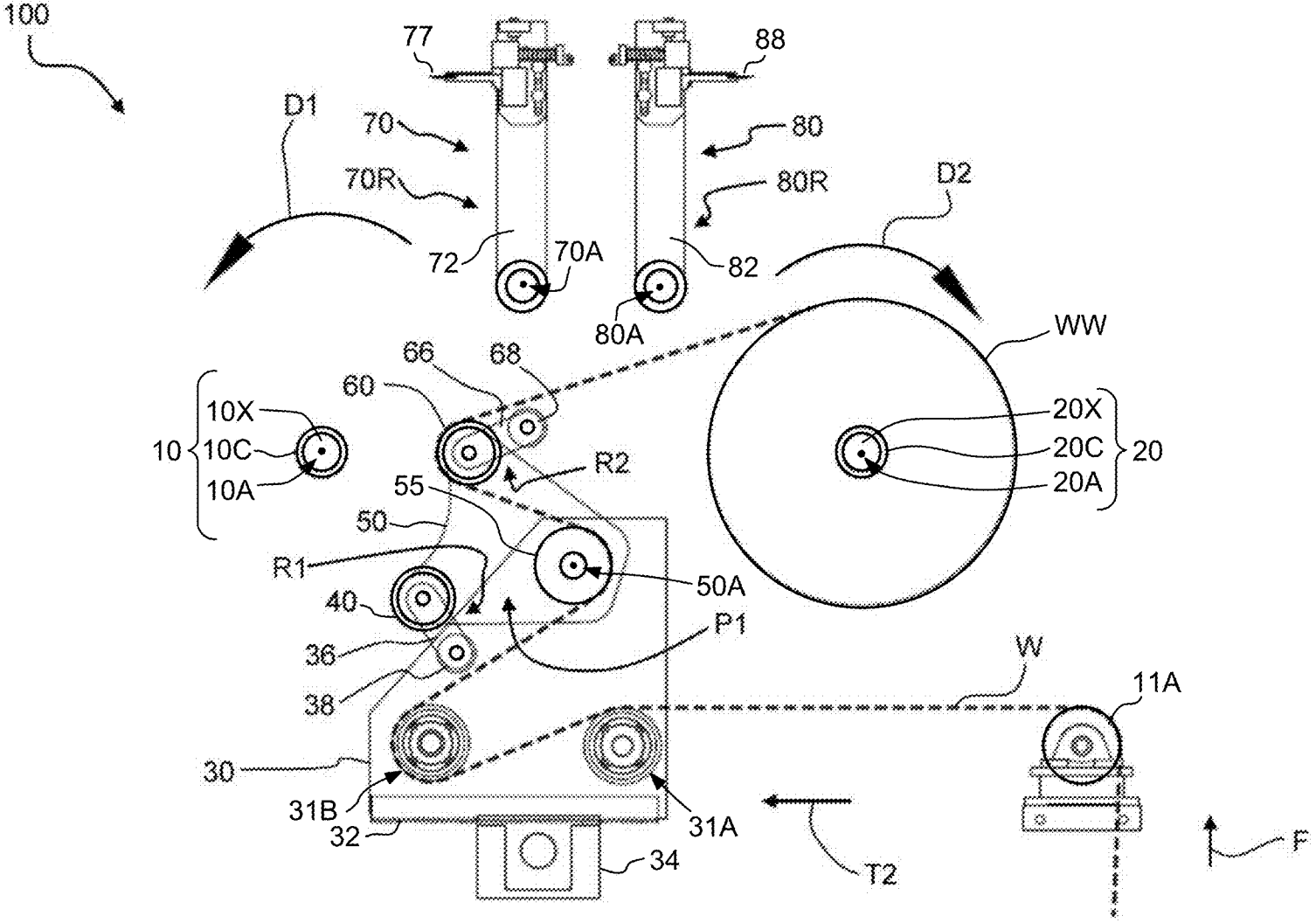
FIG. 12 is a schematic view of Step 9 of FIG. 9.

When the second core 20C nears its capacity for receiving the web W as shown in FIG. 10, the transfer process is initiated, which includes Step 8 of FIG. 9 in which the roll changer carriage 30 backs away from the filled second core 20C and towards the first core 10C, in the direction of the arrow T2, as shown in FIGS. 11 and 12.

Figure 13:
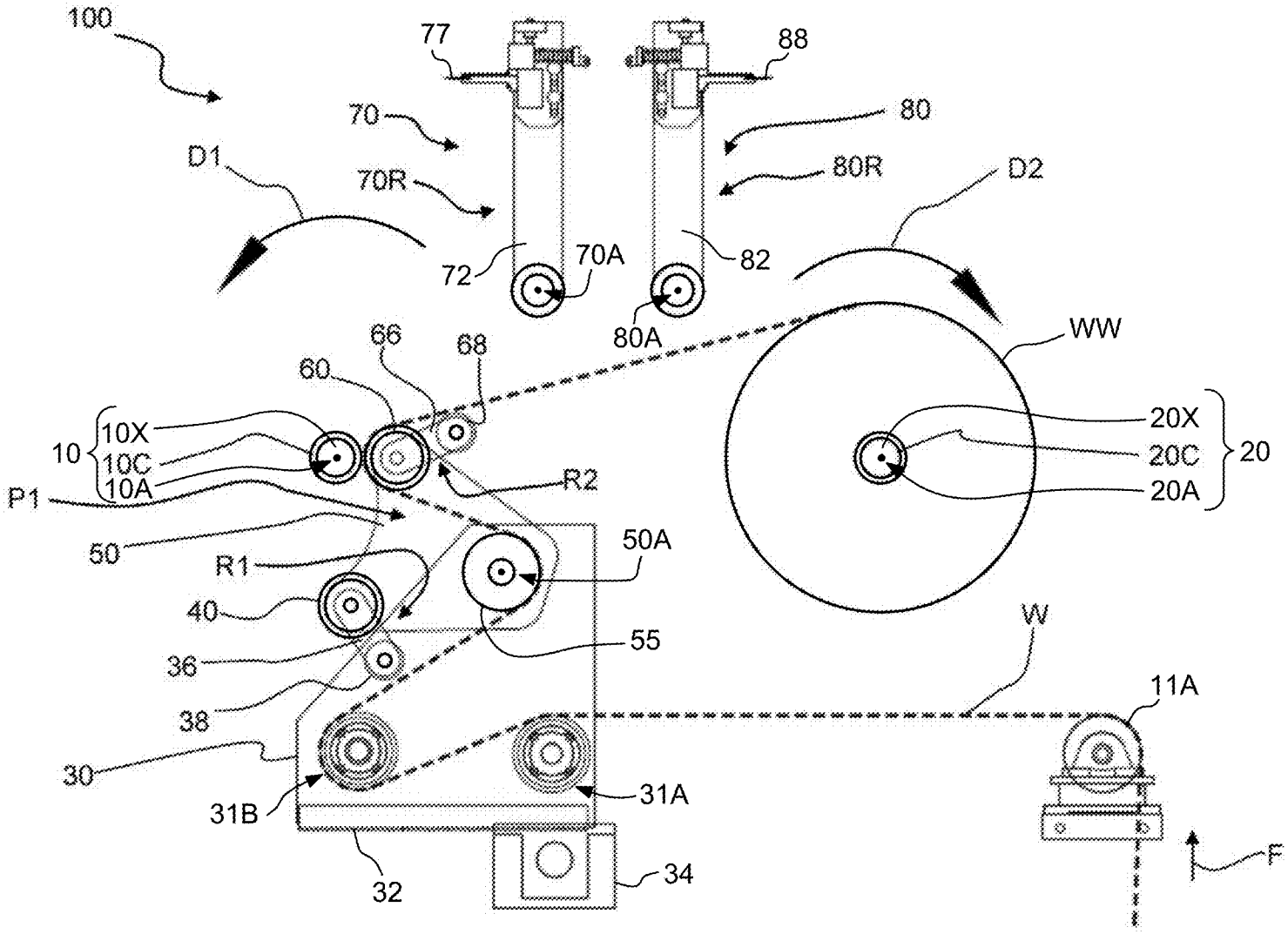
FIG. 13 is a schematic view of Step 9 of FIG. 9.
Figure 20:
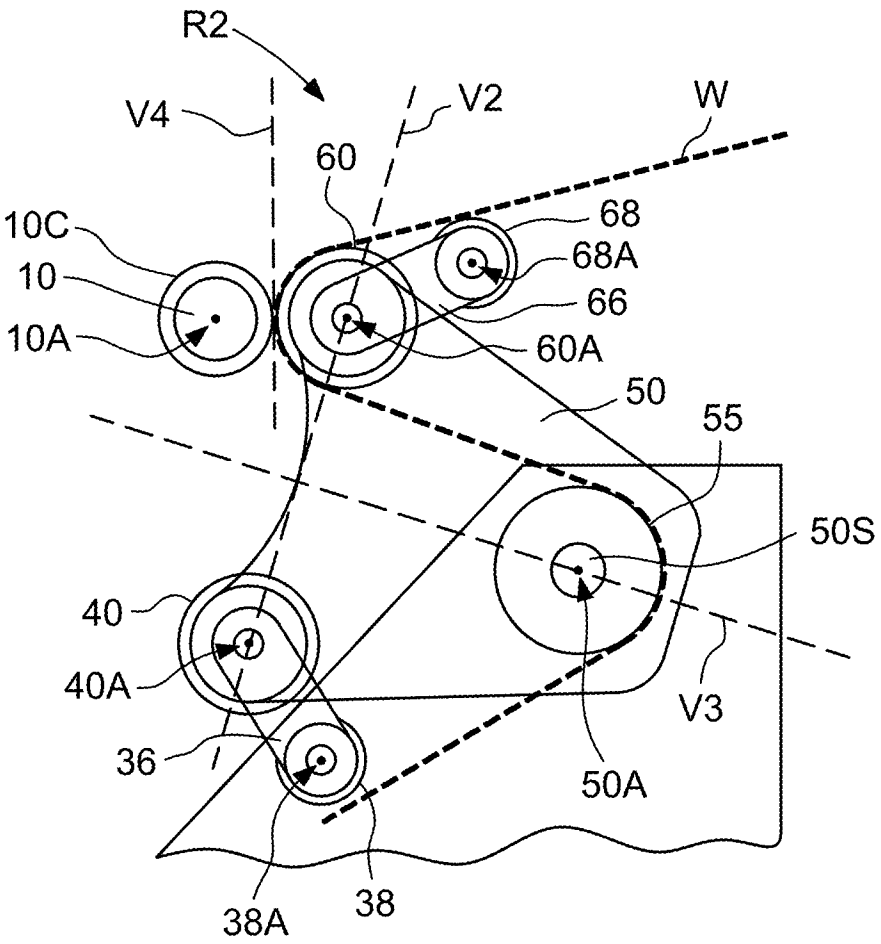
FIG. 20 is a schematic view of the linkage with the second lay-on roll in the second retracted position.
Figure 21:
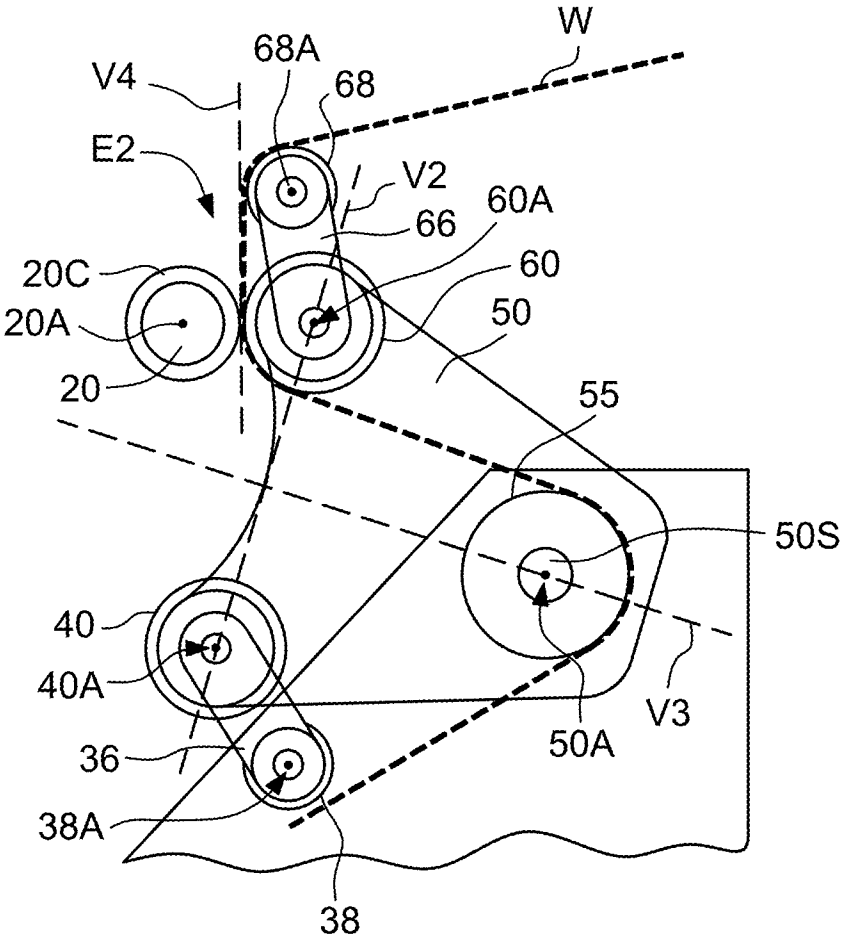
FIG. 21 is a schematic view of the linkage with the second lay-on roll in the second extended position.

In Step 9 of FIG. 9, the linkage 50 pivots the second lay-on roll 60 in close proximity to the first core 10C, as shown in FIG. 13. Referring to FIGS. 20-21, when in the second retracted position R2, the second auxiliary arm 66 is pivoted away from (e.g., at an oblique angle with respect to) a fourth virtual plane V4 that bisects the second lay-on roll 60 and the first winder 10 when the second lay-on roll 60 is in close proximity to the first winder 10. When in the second retracted position R2, the second auxiliary idler roll 68 is on the same side of the fourth virtual plane V4 as the crown roll 55. When in the second retracted position R2, the second auxiliary idler roll 68 is on the same side of second virtual plane V2 as the crown roll 55. When the second lay-on roll 60 is in close proximity to the first core 10C, the second auxiliary idler roll 68 is on the same side of the third virtual plane V3 as the first core 10C.

Figure 14:
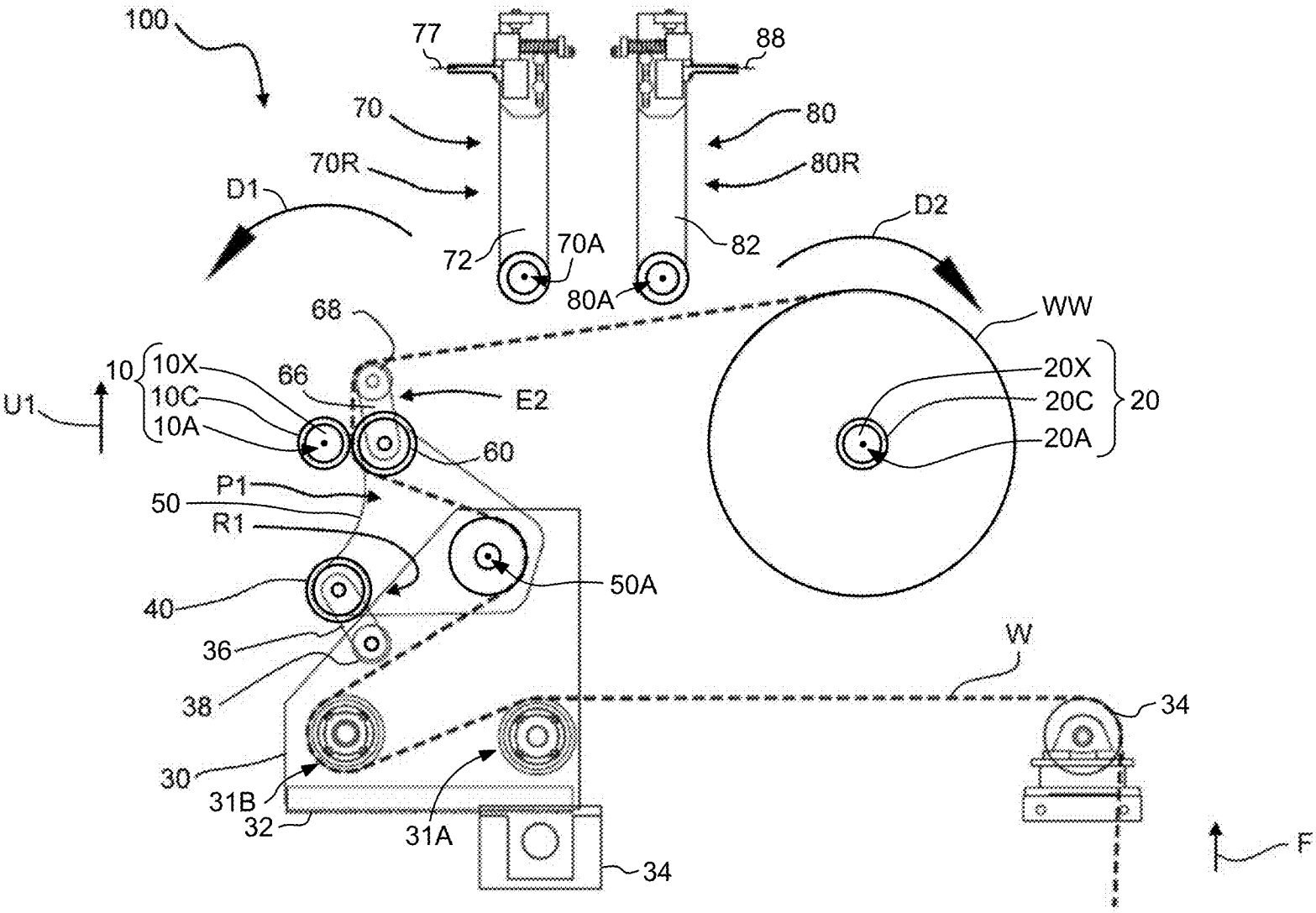
FIG. 14 is a schematic view of Step 10 of FIG. 9.

In Step 10 of FIG. 9, the second auxiliary arm 66 pivots the second auxiliary idler roll 68 into the engaged position E2, as shown in FIG. 14. Referring to FIGS. 20-21, when in the second engaged position E2, the second auxiliary arm 66 is oriented approximately parallel with the fourth virtual plane V4. When in the second engaged position E2, the second auxiliary idler roll 68 is on the same side of the fourth virtual plane V4 as the crown roll 55. When in the second engaged position E2, the second auxiliary idler roll 68 is on a different side of the second virtual plane V2 from the crown roll 55. In some embodiments, when the second auxiliary idler roll 68 is in the second engaged position E2, the first auxiliary idler roll 38 is retracted and does not contact the Web W.

In Step 11 of the method of FIG. 9, the first web-cutter arm 72 pivots the first web-cutter 70 to the cutting position 70C to cut the web W with the first cutting edge 77, as shown in FIG. 15.

Figure 16:
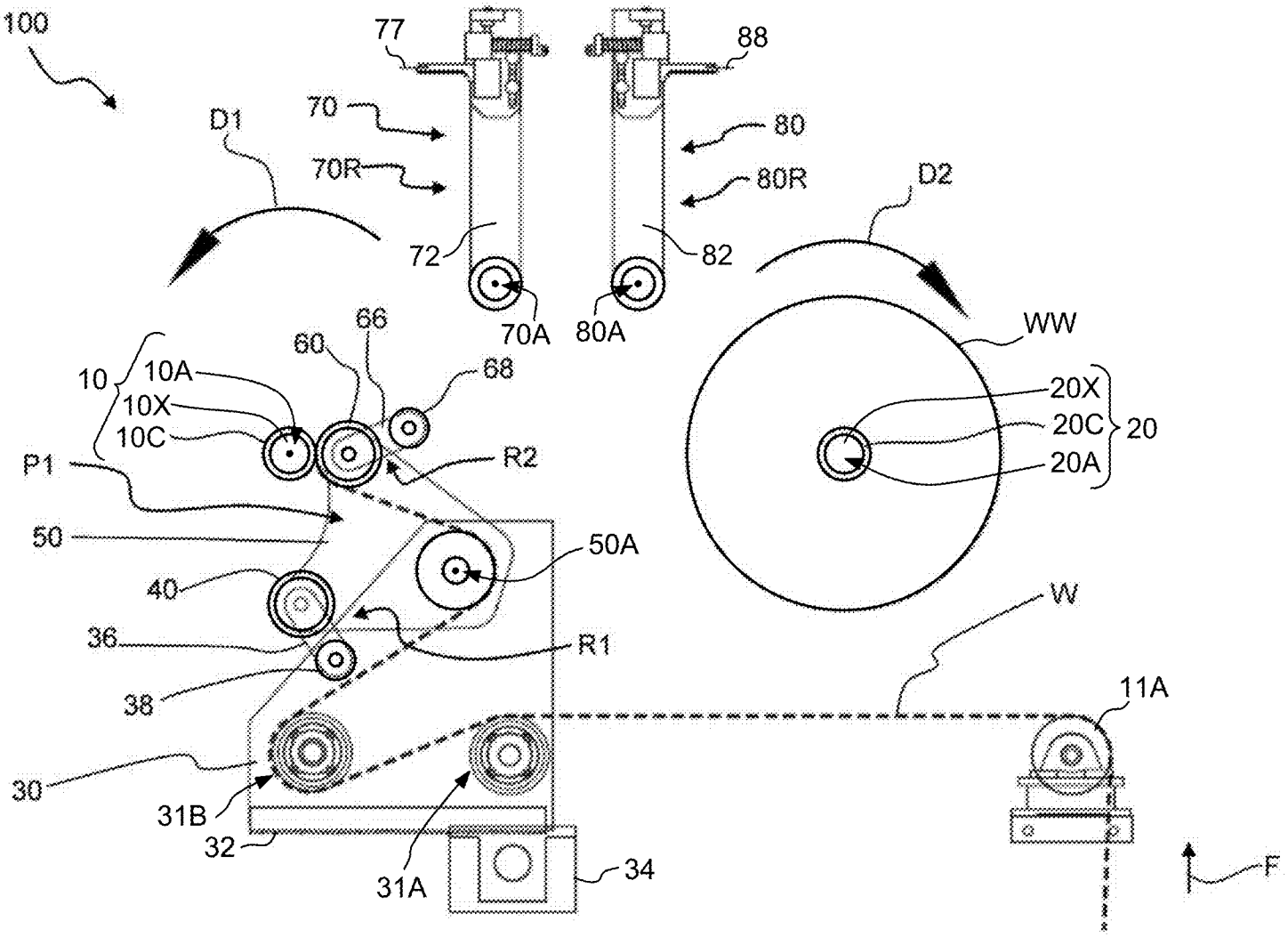
FIG. 16 is a schematic view of Step 12 of FIG. 9.

In Step 12 of the method of FIG. 9, the web W is wound on the first core 10C, the first web-cutter arm 72 pivots the web-cutter 70 to the retracted position 70R and the linkage 50 pivots the second lay-on roll 60 to assist winding the web W on the first core 10C, as shown in FIG. 16.

Figure 17:
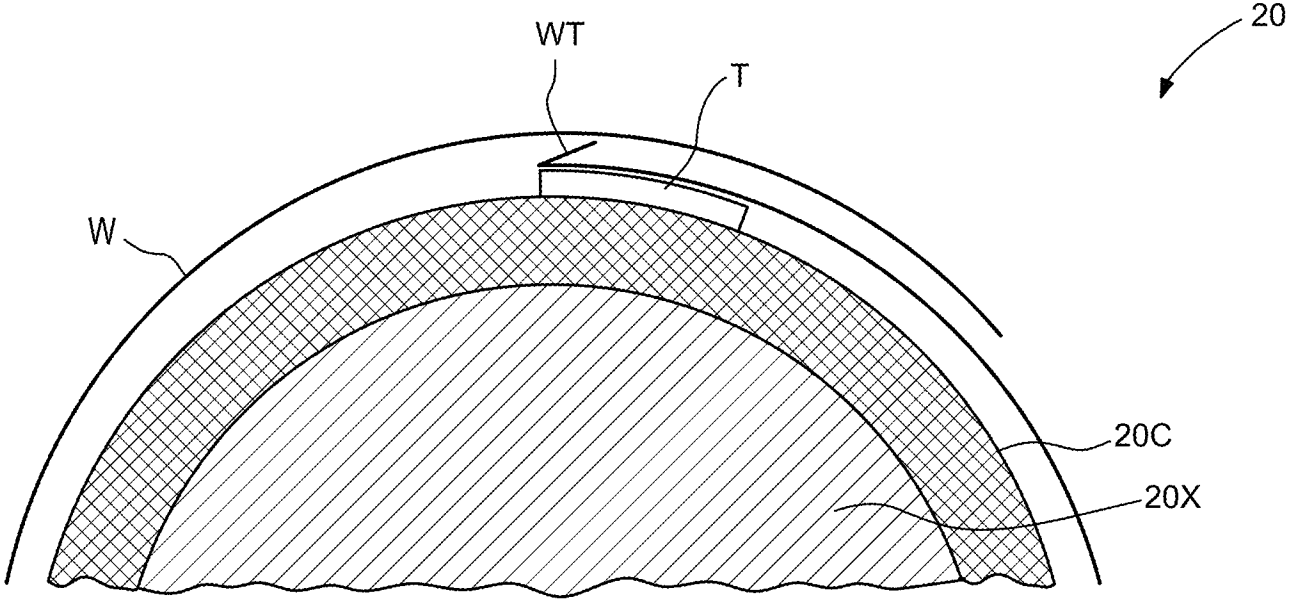
FIG. 17 is a schematic view of the second winder.

Based on the foregoing Steps, the method of utilizing the web transfer system 100 for transferring a web W between two winder spindles (e.g., the first core 10C positioned on the first spindle 10X and the second core 20C positioned on the second spindle 20X) includes pivoting the linkage 50 so that the second lay-on roll 60 is in proximity to the first core 10C and when the first core 10C is approaching full capacity the roll changer carriage 30 is backed away from the first core 10C and towards the second core 20C. The linkage 50 is pivoted so that the first lay-on roll 60 is in proximity to the second core 20C. The method includes pivoting the first auxiliary arm 36 so that the first auxiliary idler roll 38 is in an engaged position E1 and subsequently pivoting the second web-cutter arm 82 so that the second web-cutter 80 is in the cutting position 80C. The method includes cutting the web W with the second cutting edge 88 thereby severing the web W from the first core 10C and transferring the web W to the second core 20C. As illustrated in FIG. 17, the web W is transferred to the second core 20C with substantially no tail or a short tail WT. For example, the tail WT may be less than ½" or approximately ¼". The short tail is achieved by having adhesive tape T placed onto the second core 20C in preparation for roll changeover and by having the second cutting edge 88 in close proximity to both the second core 20 and the first lay-on roll 40 during cutover (i.e., approximately ¼"). The first lay-on roll 40 seals the tape T (on the second core 20) to the web W and in turn pulls the web W through the second cutting edge 88, which severs the web W. This creates the short tail WT with little to no foldback at the start of winding. The short tail WT is advantageous because it does not interfere with the winding of the web W on the roll 20C.

The method includes pivoting the second web-cutter arm 82 so that the second web-cutter 80 is moved to the retracted position 80R.

The method includes pivoting the linkage 50 so that the first lay-on roll 40 assists winding the web W on the second core 20C.

When the second core 20C approaches full capacity for winding the web W, the roll change carriage 30 backs away from the second core 20C toward the first core 10C, followed by the linkage 50 pivoting the second lay-on roll 60 in close proximity to the first core 10C.

The method further includes, pivoting the second auxiliary arm 66 so the first auxiliary idler roll 68 into the engaged position E2, followed by pivoting the first web-cutter arm 72 so that the first web-cutter 70 is in the cutting position 70C. The method also includes, cutting the web W with the first cutting edge 77 thereby severing the web W from the second core 20C and transferring the web W to the first core 10C. The web W is transferred to the first core 10C with substantially no tail. The first web-cutter arm 72 pivots the web-cutter 70 to the retracted position 70R. The linkage 50 pivots the second lay-on roll 60 to assist winding the web W on the first core 10C.

As will be apparent to those skilled in the art, various modifications, adaptations, and variations of the foregoing specific disclosure can be made without departing from the scope of the invention claimed herein. The various features and elements of the invention described herein may be combined in a manner different than the specific examples described or claimed herein without departing from the scope of the invention. In other words, any element or feature may be combined with any other element or feature in different embodiments, unless there is an obvious or inherent incompatibility between the two, or it is specifically excluded.

Various embodiments are described by the following items.

Item 1—A web transfer system (100) comprising: a first winder (10) fixedly mounted to a foundation, the first winder (10) having a first spindle (10X) rotatable about a first spindle axis (10A) and a first core (10C) removably mounted on the first spindle (10X) with a web (W) rolled thereon; a second winder (20) fixedly mounted to the foundation and being spaced apart from the first winder (10), the second winder (20) having a second spindle (20X) rotatable about a second spindle axis (20A) and a second core (20C) removably mounted on the second spindle (20X); a roll changer carriage (30) moveably mounted on a track (32), a carriage actuator (34) being in communication with the roll changer carriage (30), a linkage (50) is pivotally mounted to the roll changer carriage (30) about a linkage axis (50A), the linkage (50) being movable between a first roll transfer position (P1) and a second roll transfer position (P2), the linkage (50) comprising: (a) a first lay-on roll (40) rotatably mounted to the linkage (50) about a first lay-on roll axis of rotation (40A), a first auxiliary arm (36) pivotally mounted about the first lay-on roll axis of rotation (40A) and being pivotable between a first retracted position (R1) and a first extended position (E1), a first distal end (36D) of the first auxiliary arm (36) having a first auxiliary idler roll (38) rotatably mounted thereon; and (b) a second lay-on roll (60) rotatably mounted to the linkage (50) about a second axis of rotation (B), a second auxiliary arm (66) pivotally mounted about the second auxiliary arm axis of rotation (66B) and being pivotable between a second retracted position (R2) and a second extended position (E2), a second distal end (66D) of the second auxiliary arm (66) having a second auxiliary idler roll (68) rotatably mounted thereon; wherein the first lay-on roll (40) and the first auxiliary idler roll (38) are configured to transfer a web (W) wound around the first core (10C) to the second core (20C) and the second lay-on roll (60) and the second auxiliary idler roll (68) are configured to transfer the web (W) wound around the second core (20C) to the first core (10C).

Item 2—The web transfer system (100) of item 1, further comprising a first web-cutter (70) having a first web-cutter arm (72) pivotally mounted on a first web-cutter axis (70A) and a first cutting edge (77) positioned on a distal end of the first web-cutter arm (72), the first web-cutter (70) being pivotal between a retracted position (70R) and a cutting position (70C) in which the web (W) is cut.

Item 3—The web transfer system (100) of item 2, further comprising a second web-cutter (80) having a second web-cutter arm (82) pivotally mounted on a second web-cutter axis (80A) and a second cutting edge (88) positioned on a distal end of the second web-cutter arm (82), the second web-cutter (80) being pivotal between a retracted position (80R) and a cutting position (80C) in which the web (W) is cut.

Item 4—The web transfer system (100) of item 1, wherein the first auxiliary idler roll (38) is pivotable to the first extended position (E1) during cutting and transfer of the web (W) from the first core (10C) to the second core (20C).

Item 5—The web transfer system (100) of item 1, wherein the second auxiliary idler roll (68) is pivotable to the extended position (E2) during cutting and transfer of the web (W) from the second core to the first core (10C).

Item 6—The web transfer system (100) of item 1, further comprising a crown roll (55) pivotally mounted about the linkage axis (50A), the crown roll (55) being in rolling engagement with the web (W).

Item 7—A method of transferring a web between two winder spindles, the method comprising: providing the web transfer system (100) of any of the preceding claims; pivoting the linkage (50) so that the second lay-on roll (60) is in proximity to the first core (10C); backing the roll changer carriage (30) away from the first core (10C) and towards the second core (20C); pivoting the linkage (50) so that the first lay-on roll (60) is in proximity to the second core (20C); pivoting the first auxiliary arm (36) so that the first auxiliary idler roll (38) is in an engaged position (E1); pivoting the second web-cutter arm (82) so that the second web-cutter (80) is in the cutting position (80C); and cutting the web (W) with the second cutting edge (88) thereby severing the web (W) from the first core (10C) and transferring the web (W) to the second core (20C).

Item 8—The method of item 7, wherein the web (W) is transferred to the second core (20C) with substantially no tail.

Item 9—The method of item 7, wherein the second web-cutter arm (82) pivots the second web-cutter (80) to the retracted position (80R).

Item 10—The method of item 7, wherein the linkage (50) pivots the first lay-on roll (40) to assist winding the web (W) on the second core (20C).

Item 11—The method of item 10, wherein when the second core (20C) is filled with the web (W), the roll change carriage (30) backs away from the second core (20C) toward the first core (10C).

Item 12—The method of item 11, wherein the linkage (50) pivots the second lay-on roll (60) in close proximity to the first core (10C).

Item 13—The method of item 12, wherein the second auxiliary arm (66) pivots the first auxiliary idler roll (68) into the engaged position (E2).

Item 14—The method of item 12, wherein the first web-cutter arm (72) pivots the first web-cutter (70) to the cutting position (70C).

Item 15—The method of item 13, cutting the web (W) with the first cutting edge (77) thereby severing the web (W) from the second core (20C) and transferring the web (W) to the first core (10C).

Item 16—The method of item 15, wherein the web (W) is transferred to the first core (10C) with substantially no tail.

Item 17—The method of item 16, wherein the first web-cutter arm (72) pivots the web-cutter (70) to the retracted position (70R).

Item 18—The method of claim 17, the linkage (50) pivots the second lay-on roll (60) to assist winding the web (W) on the first core (10C).

References in the specification to "one embodiment," "an embodiment," "some embodiments," etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification.

The singular forms "a," "an," and "the" include plural reference unless the context clearly dictates otherwise. Thus, for example, a reference to "a plant" includes a plurality of such plants. It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition, or step being referred to is an optional (not required) feature of the invention.

The term "and/or" means any one of the items, any combination of the items, or all of the items with which this term is associated. The phrase "one or more" is readily understood by one of skill in the art, particularly when read in context of its usage.

Each numerical or measured value in this specification is modified by the term "about." The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by the skilled artisan, all numbers, including those expressing quantities of reagents or ingredients, properties such as molecular weight, reaction conditions, and so forth, are approximations and are understood as being optionally modified in all instances by the term "about." These values can vary depending upon the desired properties sought to be obtained by those skilled in the art utilizing the teachings of the descriptions herein. It is also understood that such values inherently contain variability necessarily resulting from the standard deviations found in their respective testing measurements.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third, and upper third, etc.

As will also be understood by one skilled in the art, all language such as "up to," "at least," "greater than," "less than," "more than," "or more," and the like, include the number recited and such terms refer to ranges that can be subsequently broken down into sub-ranges as discussed above. In the same manner, all ratios recited herein also include all sub-ratios falling within the broader ratio. Accordingly, specific values recited for radicals, substituents, and ranges, are for illustration only; they do not exclude other defined values or other values within defined ranges for radicals and substituents.

One skilled in the art will also readily recognize that where members are grouped together in a common manner, such as in a Markush group, the invention encompasses not only the entire group listed as a whole, but each member of the group individually and all possible subgroups of the main group. Additionally, for all purposes, the invention encompasses not only the main group, but also the main group absent one or more of the group members. The invention therefore envisages the explicit exclusion of any one or more of members of a recited group. Accordingly, provisos may apply to any of the disclosed categories or embodiments whereby any one or more of the recited elements, species, or embodiments, may be excluded from such categories or embodiments, for example, as used in an explicit negative limitation.

What is claimed is:

1. A web transfer system, comprising:

a first winder fixedly mounted to a foundation, the first winder having a first spindle rotatable about a first spindle axis;

a second winder fixedly mounted to the foundation and being spaced apart from the first winder, the second winder having a second spindle rotatable about a second spindle axis;

a roll changer carriage moveably mounted on a track;

a carriage actuator configured to actuate the roll changer carriage;

a linkage pivotally mounted to the roll changer carriage about a linkage axis, the linkage being movable between a first roll transfer position and a second roll transfer position;

a first lay-on roll rotatably mounted to the linkage about a first axis of rotation;

a first auxiliary arm pivotally mounted about the first axis of rotation and being pivotable between a first retracted position and a first extended position; and a first auxiliary idler roll rotatably mounted on a first distal end of the first auxiliary arm, wherein the first lay-on roll and the first auxiliary idler roll are configured to transfer a web that is wound around a first core on the first spindle to a second core on the second spindle;

a second lay-on roll rotatably mounted to the linkage about a second axis of rotation;

a second auxiliary arm pivotally mounted about the second axis of rotation so as to be pivotable between a second retracted position and a second extended position; and a second auxiliary idler roll rotatably mounted on a second distal end of the second auxiliary arm.

2. The web transfer system of claim 1, wherein the second lay-on roll and the second auxiliary idler roll are configured to transfer the web that is wound around the second core on the second spindle to another first core on the first spindle.

3. The web transfer system of claim 2, further comprising a first web-cutter having a first web-cutter arm pivotally mounted on a first web-cutter axis and a first cutting edge positioned on a distal end of the first web-cutter arm, the first web-cutter being pivotal between a retracted position and a cutting position in which the web is cut.

4. The web transfer system of claim 3, further comprising a second web-cutter having a second web-cutter arm pivotally mounted on a second web-cutter axis and a second cutting edge positioned on a distal end of the second web-cutter arm, the second web-cutter being pivotal between a retracted position and a cutting position in which the web is cut.

5. The web transfer system of claim 2, wherein the first auxiliary idler roll is configured to be in the first extended position during cutting and transfer of the web from the first core to the second core.

6. The web transfer system of claim 2, wherein the second auxiliary idler roll is configured to be in the second extended position during cutting and transfer of the web from the second core to the first core.

7. The web transfer system of claim 2, further comprising a crown roll pivotally mounted about the linkage axis, the crown roll configured to be in rolling engagement with the web.

8. A method of transferring a web between two winder spindles, the method comprising:

providing the web transfer system of claim 2;

pivoting the linkage so that the second lay-on roll is in proximity to the first core;

backing the roll changer carriage away from the first core and towards the second core;

pivoting the linkage so that the first lay-on roll is in proximity to the second core;

pivoting the first auxiliary arm so that the first auxiliary idler roll is in an engaged position;

pivoting the second web-cutter arm so that the second web-cutter is in the cutting position; and cutting the web with the second cutting edge thereby severing the web from the first core and transferring the web to the second core.

9. The method of claim 8, wherein the web is transferred to the second core with substantially no tail.

10. The method of claim 8, wherein the second web-cutter arm pivots the second web-cutter to the retracted position.

11. The method of claim 8, wherein the linkage pivots the first lay-on roll to assist winding the web on the second core.

12. The method of claim 11, wherein when the second core is filled with the web, the roll change carriage backs away from the second core toward the first core.

13. The method of claim 12, wherein the linkage pivots the second lay-on roll in proximity to the first core.

14. The method of claim 13, wherein the second auxiliary arm pivots the first auxiliary idler roll into the engaged position.

15. The method of claim 14, further comprising cutting the web with the first cutting edge thereby severing the web from the second core and transferring the web to the first core.

16. The method of claim 13, wherein the first web-cutter arm pivots the first web-cutter to the cutting position.

17. The method of claim 12, wherein the web is transferred to the first core with substantially no tail.

18. The method of claim 17, wherein the first web-cutter arm pivots the web-cutter to the retracted position.

19. The method of claim 18, wherein the linkage pivots the second lay-on roll to assist winding the web on the first core.

* * * * *